United States Patent [19]

Chen et al.

[11] Patent Number: 5,055,749

[45] Date of Patent: Oct. 8, 1991

[54] SELF-CONVERGENT ELECTRON GUN SYSTEM

[75] Inventors: Hsing-Yao Chen, Barrington; Richard M. Gorski, Arlington Heights, both of Ill.

[73] Assignee: Zenith Electronics Corporation, Glenview, Ill.

[21] Appl. No.: 579,128

[22] Filed: Sep. 6, 1990

Related U.S. Application Data

[63] Continuation-in-part of Ser. No. 392,630, Aug. 11, 1989.

[51] Int. Cl.[5] ..... H01J 29/70; H01J 29/76

[52] U.S. Cl. ..... 315/368 R; 315/382

[58] Field of Search ..... 315/382, 15, 368; 313/414

[56] References Cited

U.S. PATENT DOCUMENTS

| | | | |
|---|---|---|---|
| 3,772,554 | 11/1973 | Hughes . | |
| 4,058,753 | 11/1977 | Blacker et al. . | |
| 4,701,677 | 10/1987 | Ashizaki et al. | 315/382 |
| 4,771,216 | 9/1988 | Blacker et al. . | |
| 4,814,670 | 3/1989 | Suzuki et al. | 315/15 |
| 4,886,999 | 12/1989 | Yamane et al. | 313/414 |

*Primary Examiner*—Theodore M. Blum

[57] ABSTRACT

Apparatus in a three-beam inline electron gun system for a color cathode ray tube, wherein the tube has a screen and a partially self-converging yoke which partially, but incompletely, converges the three beams and undesirably imparts astigmatism to the beams in off-center regions of the screen, applies a field-strength-dependent asymmetrical field to the two outer beams to provide partial dynamic convergence. The apparatus includes an electron beam source for developing three electron beams, a focusing lens portion for focusing the three electron beams at the tube screen, an astigmatism correcting lens portion for developing an astigmatic field component in the path of each of the beams, and a modulated voltage source for modulating the strength of the astigmatic field component as a function of beam deflection angle to at least partially compensate for the yoke-induced astigmatism and for modulating focus field strength in providing partial dynamic electron beam convergence. The astigmatism correcting lens portion includes an electrode having outer beam apertures shaped to create field-strength-dependent asymmetric outer beam fields and to produce partial dynamic convergence, with the dynamic convergence effects of the yoke, the focusing lens portion, and the astigmatism correcting lens portion combining additively.

24 Claims, 9 Drawing Sheets

NEGATIVE ASTIGMATISM CORRECTION

POSITIVE ASTIGMATISM CORRECTION

BIPOTENTIAL TYPE ML DESIGN

EINZEL TYPE ML DESIGN

QPF TYPE ML DESIGN

BU TYPE ML DESIGN

SELF-CONVERGENT ELECTRON GUN SYSTEM

CROSS-REFERENCE TO RELATED APPLICATIONS

This application is a continuation-in-part of an application Ser. No. 392,630, filed Aug. 11, 1989. It is related to but in no way dependent upon co-pending application Ser. No. 521,505, filed May 10, 1990.

BACKGROUND OF THE INVENTION

This invention relates generally to color cathode ray tubes (CRTs) and is particularly directed to the control of multiple electron beams incident upon the faceplate of a color CRT.

Most color CRTs employ an inline electron gun arrangement for directing a plurality of electron beams on the phosphorescing inner screen of its glass faceplate. The inline electron gun approach offers various advantages over earlier "delta" electron gun arrangements particularly in simplifying the electron beam positioning control system as well as essentially eliminating the tendency of the electron beams to drift. However, inline color CRT's employ a self-converging deflection yoke which applies a nonuniform magnetic field to the electron beams, resulting in an undesirable astigmatism in and defocusing of the electron beam spot displayed on the CRT's faceplate. In order to achieve three electron beam convergence at the screen edges and corners, the self-converging yoke applies a dynamic quadrupole magnetic field to the beams which over-focuses the beams in the vertical direction and under-focus them in the horizontal direction. This is an inherent operating characteristic of the inline yoke design.

One approach to eliminate this astigmatism and deflection defocus employs a quadrupole lens with the CRT's focusing electrode which is oriented 90° from the self-converging yoke's quadrupole field. A dynamic voltage, synchronized with electron beam deflection, is applied to the quadrupole lens to compensate for the astigmatism caused by the deflection system. This dynamic voltage also allows for dynamic focusing of the electron beams over the entire CRT screen. The astigmatism of the electron beam caused by the quadrupole lens tends to offset the astigmatism caused by the color CRT's self-converging deflection yoke and generally improves the performance of the CRT.

In order to achieve the three beam dynamic convergence at the screen corners, the yoke fields over focus the beams in the vertical direction and under focus them in the horizontal direction. To a simplified model, the self-convergence inline yoke's magnetic fields can be represented by a uniform two pole magnetic field plus a quadrupole magnetic field, as shown in FIG. 1, for both horizontal and vertical deflection fields. This is an inherent property of the inline yoke design and there is no trade-off (in yoke design alone) making it possible to achieve both the three-beam self-convergence plus good edge and corner focus at the same time.

Basically, these dynamic quadrupole designs use a split focus grid either 2 parts (bipotential) or 3 parts (Einzel). On these split focus grids some type of electrostatic quadrupole shaped grid design is used. When there is a voltage difference between the split grids, an electrostatic quadrupole field is formed. The strength and timing of such an electrostatic quadrupole can be controlled to cancel the inline yoke's undesirable negative quadrupole effect, and improve the spot size performance over both the center and corners. In recent years some manufacturers have further proposed using a uniform field yoke plus a separate magnetic quadrupole coil to achieve homogeneous spot performance over the whole screen.

An article entitled "Progressive-Scanned 33-in. 110° Flat-Square Color CRT" by Suzuki et al published in SID 87 Digest, at page 166, discloses a dynamic astigmatism and focus (DAF) gun wherein spot astigmatism and deflection defocusing is simultaneously corrected using a single dynamic voltage. The electron gun employs a quadrupole lens to which the dynamic voltage is applied and which includes a plurality of generally vertically elongated apertures in a first section of a focusing electrode and a second pair of aligned, generally horizontally oriented elongated apertures in a second section of the focusing electrode. Each electron beam first transits a vertically aligned aperture, followed by passage through a generally horizontally aligned aperture in the single quadrupole lens for applying astigmatism correction to the electron beam.

An article entitled "Quadrupole Lens For Dynamic Focus and Astigmatism Control in an Elliptical Aperture Lens Gun" by Shirai et al, also published in SID 87 Digest, at page 162, discloses a quadrupole lens arrangement comprised of three closely spaced electrodes, where the center electrode is provided with a plurality of keyhole apertures and the outer electrodes are provided with a plurality of square recesses each with a circular aperture in alignment with each of the respective electron beams. A dynamic voltage $V_d$ is applied to the first and third electrodes so as to form a quadrupole field to compensate for the astigmatism caused by the self converging yoke deflection system. Although this allows for a reduction in the dynamic voltage applied to the quadrupole, this voltage still exceeds 1 KV in this approach. While these two articles describe improved approaches for beam focusing and astigmatism compensation, they too suffer from performance limitations particularly in the case of those CRTs having a flat faceplate and foil tension shadow mask, where the flat geometry imposes substantially greater challenges than those encountered with a curved faceplate.

An electron gun employing a quadrupole lens to which a dynamic voltage is applied generally also includes a Beam Forming Region (BFR) refraction lens design intended to correct for the lack of dynamic convergence of the red and blue outer electron beams. The horizontal beam landing locations of the red and blue beams in color CRTs having an inline electron gun arrangement change with variations in the focus voltage applied to the electron gun. While the dynamic quadrupole lens compensates for astigmatism caused by the self-converging electron beam deflection yoke, prior art quadrupole lens arrangements do not address the lack of horizontal convergence of the two outer electron beams.

In a more general sense, this invention addresses the problem of how to electrically converge off-axis beams in a three-beam color cathode ray tube, particularly a color cathode ray tube of the type having an inline gun.

There exists a number of techniques in the prior art for electrically converging off-axis electron beams in a color cathode ray tube. One technique offsets the axes of apertures in facing electrodes. Offsetting the axes of the cooperating apertures creates an asymmetrical field which bends an electron beam in a direction dependent upon the asymmetry and strength of the field. Examples of electron guns having such offset-aperture-type beam bending are U.S. Pat. Nos. 3,772,554; 4,771,216 and 4,058,753.

A second approach is to use coaxial apertures, but angle the gap between the facing electrodes to produce the necessary asymmetrical field. Examples of electron guns having such "angled gap" technique for producing the necessary asymmetrical field are disclosed in U.S. Pat. Nos. 4,771,216 and 4,058,753.

A third approach is to create the asymmetrical field for the off-axis beam or beams by creating a wedge-shaped gap between the addressing electrodes. Examples of this third approach for electrically converging off-axis beams are disclosed in U.S. Pat. Nos. 3,772,554 and 4,058,753.

Each of these three approaches suffers from difficulties in mandrelling the electrodes during assembly. One aspect of the present invention is to provide improved means in an electron gun for refracting or bending an electron beam, useful for converging off-axis beams in a color CRT gun.

As discussed above, certain modern high performance electron guns have a dynamic quadrupole lens to compensate for beam astigmatism introduced by an associated self-converging yoke. The aforementioned U.S. Pat. No. 4,771,216 discloses the use of a dynamic quadrupole lens for providing a dynamic astigmatism correction for an inline electron gun having separate aligned sets of apertures for each of the three electron beams. The disclosure and discussion of the prior art set forth in the '216 patent are relevant to the present invention and are hereby incorporated by reference in this application.

The '216 patent discloses a gun system of the type in which static convergence is achieved by creating asymmetrical fields in the paths of the off-axis beams, which asymmetrical fields can be created using offset apertures, wedged interelectrode gaps or angled gaps. In addition, a balanced quadrupole is utilized to provide astigmatism correction. The quadrupole and the means for creating the aforesaid asymmetric fields for convergence are separate. Each of the beams are focused using main focus fields which are discrete for each of the three beams.

Co-pending application Ser. No. 521,505 discloses an electron gun system having a self-converging yoke, focusing means of the type in which changes in focusing field strength alters beam convergence, and an unbalanced quadrupole. The quadrupole is provided for astigmatism correction. Application of a dynamic waveform to the astigmatism corrector has the undesired effect of producing dynamic convergence in the beam focusing means. Since full convergence is provided by the self-converging yoke, the undesired beam convergence produced by the focusing means represents convergence errors. In accordance with the invention described and claimed therein, the astigmatism-correcting quadrupole is caused to be unbalanced in a sense such as to offset the convergence errors produced by the focusing means.

There exists a need for a cathode ray tube system in which all or a major part of the beam convergence is achieved in the electron gun system. With such a gun system, self-convergence demands on the yoke may be reduced or eliminated entirely. The astigmatism of the beams inevitably produced by the self-converging yoke would thus be reduced or eliminated completely.

OTHER OBJECTS OF THE INVENTION

It is thus an object to provide for use in a cathode ray tube system, an electron gun system in which all or a major part of the beam convergence is achieved in the electron gun system.

It is an object of this invention to provide an electron gun system useful with a gun of the type in which changes in focusing field strength of the focusing means alters beam convergence. Dynamic convergence means are provided which produces dynamic convergence effects which combine additively with those produced by the aforesaid focusing means.

It is another object to provide an electron gun system having a horizontally unbalanced quadrupole for achieving dynamic beam convergence.

It is still another object to provide an electron gun system useful with a partially self-converging yoke, the gun system having convergence means producing dynamic convergence effects which combine additively with the convergence effects produced by the partially self-converging yoke in order that the beam-astigmating effects of the yoke may be mitigated.

It is still another object of the invention to provide an electron gun system useful with a partially self-converging yoke and an electron gun of the type in which changes in the strength of the main focusing field alter beam convergence, such system including an unbalanced quadrupole having dynamic convergence effects which combines additively with dynamic convergence effects produced by the focusing means and by the partially self-converging yoke.

It is yet another object to provide an electron gun system capable of producing astigmatism correction, dynamic focusing, and dynamic convergence.

Another object of the present invention is to correct for outer electron beam (typically the red and blue beams) dynamic misconvergence in inline color CRTs having dynamic astigmatism compensation particularly near the lateral portions of the CRT screen.

A still further object of the present invention is to provide a substantial portion of electron beam self-convergence required in a multi-beam color CRT in the CRT's electron gun.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
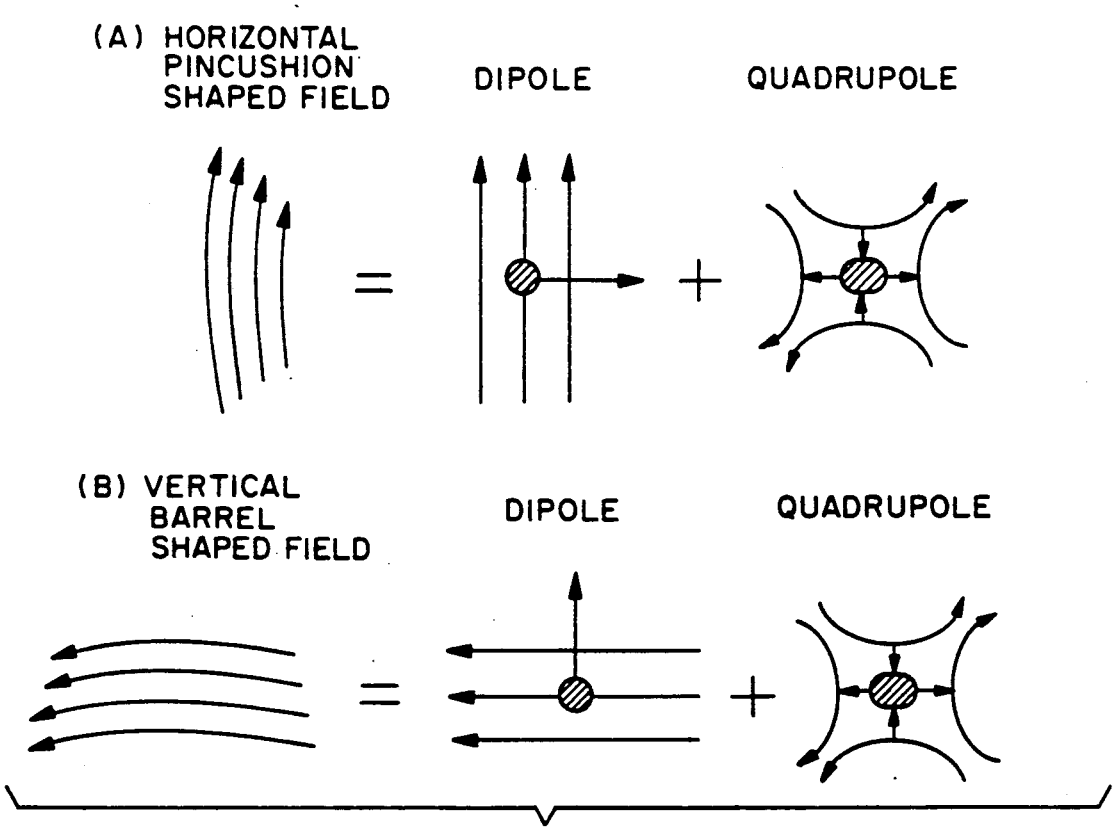
FIG. 1 illustrates in simplified form the magnetic field of a self-convergent inline magnetic deflection yoke employed in a color CRT as a uniform two pole magnetic field plus a quadrupole magnetic field for both horizontal and vertical deflection fields.
Figure 2:
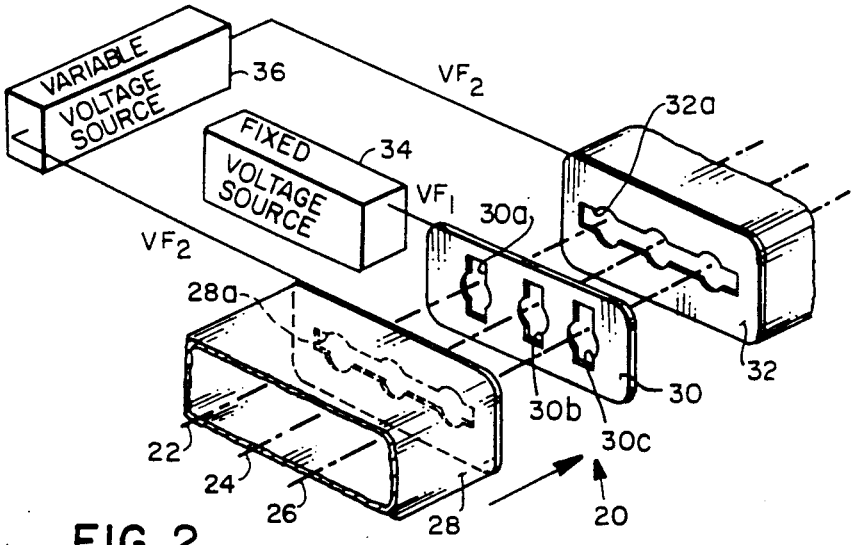
FIG. 2 is a perspective view of a dynamic quadrupole lens for an inline color CRT in accordance with the principles of the present invention.

Referring to FIG. 2, there is shown a perspective view of a dynamic quadrupole lens 20 for use in an inline electron gun in a color CRT. The manner in which the dynamic quadrupole lens of the present invention may be integrated into various existing electron gun arrangements is illustrated in FIGS. 14*a* and 14*b* through 17*a* and 17*b*, and is described in detail below. Various alternative embodiments of the dynamic quadrupole lens of the present invention are illustrated in FIGS. 11 through 17 and are discussed below. Details of the embodiment of the dynamic quadrupole lens 20 illustrated in FIG. 2 are discussed in the following paragraphs, with the principles of the present invention covered in this discussion applicable to each of the various embodiments illustrated in FIGS. 7 through 13. The present invention may be used to correct for astigmatism and provide dynamic convergence in CRTs having electron guns with a focusing field common to all three beams such as the Combined Optimum Tube and Yoke (COTY) CRTs, as well as non-Coty CRTs as described below. A COTY-type main lens is used in an inline electron gun and allows the three electron guns to have a larger vertical lens while sharing the horizontal open space in the main lens for improved spot size. The terms "electrode", "grid" and "plate" are used interchangeably in the following discussion.

The dynamic quadrupole lens 20 includes first, second and third electrodes 28, 30 and 32 arranged in mutual alignment. The first electrode 28 includes an elongated aperture 28*a* extending a substantial portion of the length of the electrode. Disposed along the length of the aperture 28*a* in a spaced manner are three enlarged portions of the aperture.

The second electrode 30 includes three keyhole-shaped apertures 30*a*, 30*b* and 30*c* arranged in a spaced manner along the length of the electrode. As in the case of the first electrode 28, the third electrode 32 includes an elongated aperture 32*a* extending along a substantial portion of the length thereof and including three spaced enlarged portions. Each of the aforementioned keyhole-shaped apertures 30*a*, 30*b* and 30*c* has a longitudinal axis which is aligned generally vertically as shown in FIG. 2, or generally transverse to the longitudinal axes of the apertures in the first and third electrodes 28 and 32. With the first, second and third electrodes 28, 30 and 32 arranged generally parallel and in linear alignment, the respective apertures of the electrodes are adapted to allow the transit of three electron beams 22, 24 and 26, each shown in the figure as a dashed line.

The second electrode 30 is coupled to a constant voltage source 34 and is charged to a fixed potential $VF_1$. The first and third electrodes 28, 32 are coupled to a variable voltage source 36 for applying a dynamic voltage $VF_2$ to these electrodes. The terms "voltage" and "potential" are used interchangeably in the following discussion. The present invention is described in detail in the following paragraphs with the dynamic and static voltages applied as indicated, although the principles of this invention also encompass applying a dynamic voltage to the second intermediate electrode 30 while maintaining the first and third electrodes 28, 32 at a fixed voltage.

Figure 3:
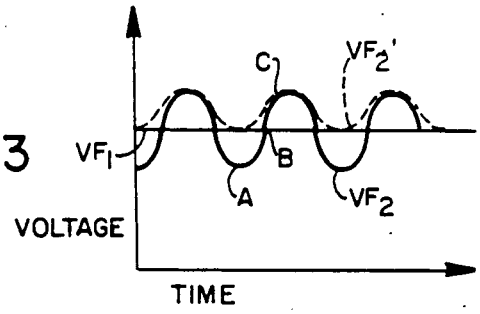
FIG. 3 is a graphic representation of the variation over time of the dynamic voltage applied to the quadrupole lens of the present invention.
Figure 4:
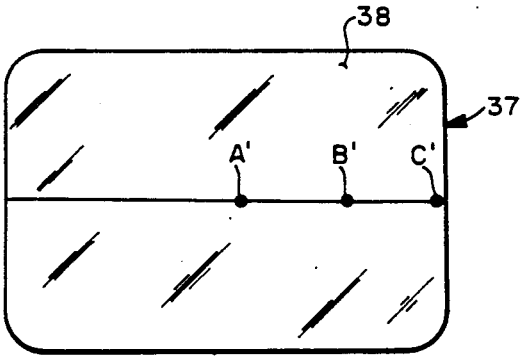
FIG. 4 is a simplified planar view of a phosphor screen on the inner surface of a CRT glass faceplate illustrating various deflection positions of the electron beams thereon.

Referring to FIG. 3, there is shown a graphic representation of the relative voltages at which the second electrode 30 and the first and third electrodes 28, 32 are maintained over time. As shown in FIG. 3, the $VF_1$ voltage is maintained at a constant value, while the $VF_2$ voltage varies in a periodic manner with electron beam sweep. The manner in which the $VF_2$ dynamic voltage varies with electron beam sweep can be explained with reference to FIG. 4 which is a simplified planar view of a CRT faceplate 37 having a phosphorescing screen 38 on the inner surface thereof. The dynamic focusing voltage $VF_2$ applied to the first and third electrodes 28, 32 varies in a periodic manner between a minimum value at point A and a maximum value at point C as shown in FIG. 3. The minimum value at point A corresponds to the electron beams positioned along a vertical centerline of the CRT screen 38 such as shown at point A' as the electron beams are deflected horizontally across the screen. As the electron beams are further deflected toward the right in FIG. 4 in the vicinity of point B, the dynamic voltage $VF_2$ increases to the value of the fixed focus voltage $VF_1$ as shown at point B in FIG. 3. Further deflection of the electron beams toward the right edge of the CRT screen 38 at point C' occurs as the dynamic focus voltage $VF_2$ increases to its maximum value at point C in FIG. 4 which is greater than $VF_1$. The dynamic voltage $VF_2$ then decreases to the value of the fixed focus voltage $VF_1$ as the electron beams are deflected leftward in FIG. 4 toward point B' which is intermediate the center and lateral edge locations on the CRT screen 38. The dynamic voltage $VF_2$ varies relative to the fixed voltage $VF_1$ in a similar manner when the electron beams are deflected to the left of point A' in FIG. 4 to cover the other half of the CRT screen. In some color CRTs currently in use, such as those of the COTY type, the dynamic focus voltage is varied in a periodic manner but does not go below the fixed focus voltage $VF_1$. This type of dynamic focus voltage is labeled $VF_2'$ in FIG. 3 and is shown in dotted line form therein. The dynamic focus voltage is applied to the first and third electrodes 28, 32 synchronously with the deflection yoke current to change the quadrupole fields applied to the electron beam so as to either converge or diverge the electron beams, depending upon their position on the CRT screen, in correcting for deflection yoke-produced astigmatism and beam defocusing effects as described below.

Figure 5A:
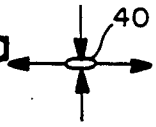
FIGS. 5*a* and 5*b* are sectional views of an electron beam respectively illustrating vertical convergence/-horizontal divergence (negative astigmatism effect) and vertical divergence/horizontal convergence (positive astigmatism effect) effected by the dynamic quadrupole lens of the present invention.
Figure 5B:
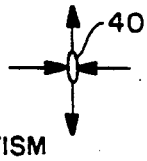

Referring to FIGS. 5*a* and 5*b*, there is shown the manner in which the spot of an electron beam 40 may be controlled by the electrostatic field of a quadrupole lens. The arrows in FIGS. 4*a* and 4*b* indicate the direction of the forces exerted upon an electron beam by the electrostatic field. In FIG. 5*a*, the quadrupole lens is horizontally diverging and vertically converging causing a negative astigmatism of the electron beam 40. This negative astigmatism corrects for the positive astigmatism of the beam introduced by a COTY-type main lens. Negative astigmatism correction is introduced when the beam is positioned in the vicinity of the vertical center of the CRT screen in a COTY-type main lens. In FIG. 5*b*, the quadrupole lens is vertically diverging and horizontally converging for introducing a positive astigmatism correction in the electron beam. Positive astigmatism correction compensates for the negative astigmatism of the electron beam spot caused by the self-converging magnetic deflection yoke as the electron beam is deflected adjacent to a lateral edge of the CRT's screen. Positive and negative astigmatism correction is applied to the electron beams in a COTY type of CRT. In a non-COTY type of CRT, only positive astigmatism is applied in the electron beams. The manner in which the present invention compensates for astigmatism in both types of CRTs is discussed in detail below.

Operation of the dynamic quadrupole lens 20 for an inline color CRT as shown in FIG. 2 will now be described with reference to Table I. Table I briefly summarizes the effect of the electrostatic field of the dynamic quadrupole lens 20 applied to an electron beam directed through the lens. The electrostatic force applied to the electrons in an electron beam by the electrostatic field of the dynamic quadrupole lens is shown in FIG. 6.

Figure 6:
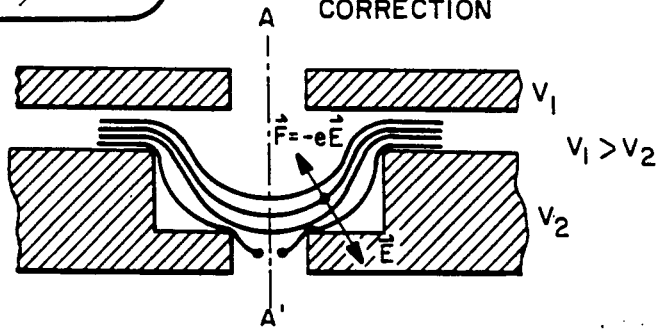
FIG. 6 is a simplified sectional view illustrating the electrostatic potential lines and electrostatic force applied to an electron in the space between two charged electrodes.

Referring to FIG. 6, there is shown a simplified illustration of the manner in which an electrostatic field, represented by the field vector $\vec{E}$, applies a force, represented by the force vector $\vec{F}$, to an electron. An electrostatic field is formed between two charged electrodes, with the upper electrode charged to a voltage of $V_1$ and the lower electrode charged to a voltage of $V_2$, where $V_1$ is greater than $V_2$. The electrostatic field vector $\vec{E}$ is directed toward the lower electrode, while the force vector $\vec{F}$ is directed toward the upper electrode because of the electron's negative charge. FIG. 6 provides a simplified illustration of the electrostatic force applied to an electron, or an electron beam, directed through apertures in adjacent charged electrodes which are maintained at different voltages.

TABLE 1

| SLOT LOCATION | MAJOR AXIS OF SLOT | FORCE DIRECTION ON THE E-BEAM | OPTICAL EFFECT ON THE E-BEAM AFTER CROSS OVER | COMMENTS |
|---|---|---|---|---|
| HIGHER VOLTAGE SIDE | VERTICAL (Y-DIRECTION) | X - AWAY FROM AXIS<br>Y - NO EFFECT | HORIZ. DIV. | (A) FIELD VECTOR "E" IS IN DIRECTION FROM HIGH VOLTAGE SIDE TO LOW VOLTAGE SIDE (EQUIPOTENTIAL LINES) |
| | HORIZ. (X-DIRECTION) | X - NO EFFECT<br>Y - AWAY FROM AXIS | VERT. DIV. | |
| LOWER VOLTAGE SIDE | VERT. (Y-DIRECTION) | X - TOWARD AXIS<br>Y - NO EFFECT | HORIZ. CONV. | |
| | HORIZ. (X-DIRECTION) | X - NO EFFECT<br>Y - TOWARD AXIS | VERT. CONV. | (B) FORCE VECTOR "F" ON ELECTRON IS EQUAL TO $-e\,E$ |

It can be seen that the relative width of the two apertures in the electrodes as well as the relative polarity of the two electrodes determines whether the electron beam is directed away from the A—A' axis (divergence), or toward the A—A' axis (convergence).

With reference to FIG. 2 in combination with Table I, the horizontal slots 28*a*, 32*a* in the first and third electrodes 28, 32 cause vertical divergence of the electron beam when they are maintained at a voltage greater than the second electrode 30 such as when the electron beams are positioned adjacent to a lateral edge of the CRT screen. With the second electrode 30 maintained at a lower voltage $VF_1$ than the other two electrodes when the electron beams are located adjacent the CRT screen's lateral edge, as shown at point C in FIG. 3, the vertically aligned apertures of the second electrode effect a horizontal convergence of the electron beams which reinforces the vertical divergence correction of the other two electrodes. This combination of vertical divergence and horizontal convergence of an electron beam 40 is shown in FIG. 5*b* and represents a positive astigmatism correction which compensates for the negative astigmatism introduced in the electron beam by the CRT's self-converging magnetic deflection yoke.

When the electron beams are positioned between the center and a lateral edge of the CRT screen, all three electrodes are at the same voltage and the dynamic quadrupole lens does not introduce either an astigmatism or a focus correction factor in the electron beams. In non-COTY CRTs, the three electrodes are also maintained at the same voltage when the electron beams are positioned on a vertical center portion of the CRT screen as shown graphically in FIG. 3 for the dynamic focus voltage $VF_2'$. In this case, because all three electrodes are again maintained at the same voltage, the dynamic quadrupole lens does not introduce a correction factor in the electron beams to compensate for deflection yoke astigmatism and defocusing effects. In COTY-type CRTs, the dynamic focusing voltage $VF_2$ applied to the first and third electrodes 28, 30 is less than the fixed voltage $VF_1$ of the second electrode 30 in the vicinity of the center of the CRT screen. With the polarity of the electrodes changed, the first and third electrodes 28, 32 introduce a vertical convergence in the electron beams as shown in Table I. The second electrode 30, now at a higher voltage than the other two electrodes, introduces a horizontal divergence by virtue of its generally vertically aligned apertures. The vertical convergence effected by the first and third electrodes 28, 32 and the horizontal divergence caused by the second electrode 30 introduces a negative astigmatism correction in the electron beams as shown in FIG. 5*a*. The negative astigmatism correction compensates for the positive astigmatism effects of a COTY-type main lens on the electron beams in the center of the CRT screen.

Although the first and third electrodes 28, 32 are each shown with a single elongated, generally horizontally aligned aperture, the present invention also contemplates providing each of these electrodes with a plurality of spaced, aligned apertures each having a horizontally oriented longitudinal axis and adapted to pass a respective one of the electron beams. In addition, while the operation of the present invention has thus far been described with the dynamic quadrupole lens positioned after electron beam cross over, or between cross over and the CRT screen, the dynamic quadrupole lens may also be positioned before beam cross over, or between the electron beam source and cross over. The effect of the dynamic quadrupole lens on the electron beams is reversed in these two arrangements as shown in Table I.

Referring to FIGS. 7 through 13, there are shown various alternative embodiments of the dynamic quadrupole lens of the present invention. In the dynamic quadrupole lens 50 of FIG. 7, the first and third electrodes 51 and 53 include respective elongated, generally rectangular apertures 51*a* and 53*a* through which the three electron beams are directed. The second electrode 52 includes a plurality of spaced, generally rectangular shaped apertures 52*a*, 52*b* and 52*c*. Each of the rectangular apertures 52*a*, 52*b* and 52*c* is aligned lengthwise in a generally vertical direction.

Figure 7:
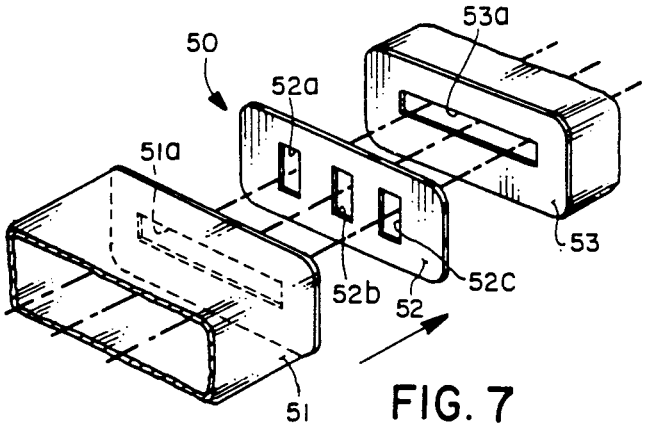
FIGS. 7 through 13 illustrate additional embodiments of a dynamic quadrupole lens for focusing a plurality of electron beams in an inline color CRT in accordance with the principles of the present invention.
Figure 9:
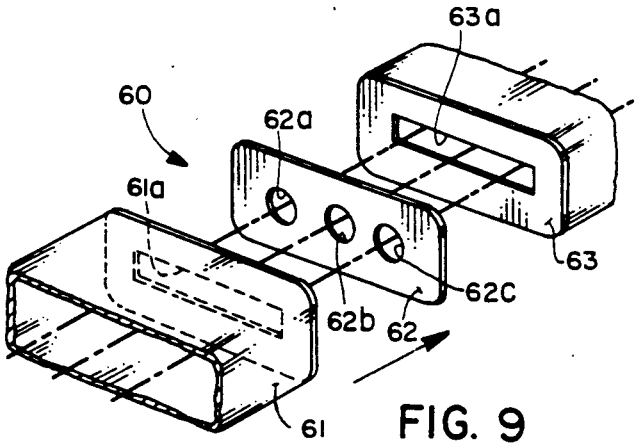

The dynamic quadrupole lens 60 of FIG. 9 is similar to that of FIG. 7 in that the first and third electrodes 61 and 63 each include a respective rectangular, horizontally oriented aperture 61*a* and 63*a*. However, in the dynamic quadrupole lens 60 of FIG. 9, the second electrode 62 includes three circular apertures 62*a*, 62*b* and 62*c*. Where circular apertures are employed, the second electrode 62 will not function as a quadrupole lens element, although the first and third electrodes 61 and 63 will continue to so operate. The three apertures 62*a*, 62*b* and 62*c* may also be elliptically shaped with their major axes oriented generally vertically, in which case the second electrode 62 will function as a quadrupole lens element to converge or diverge the electron beams, as the case may be.

Figure 8:
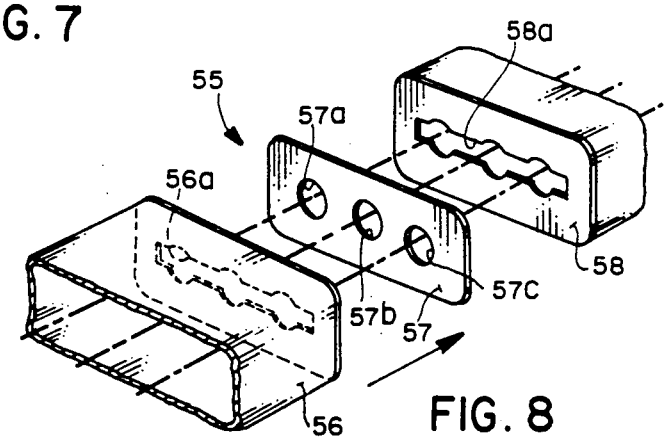
Figure 10:
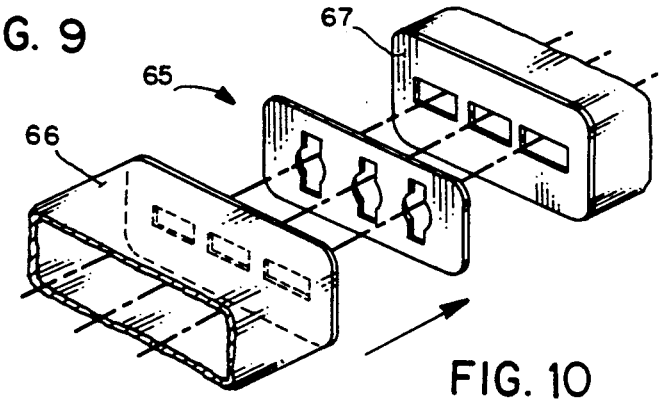
Figure 11:
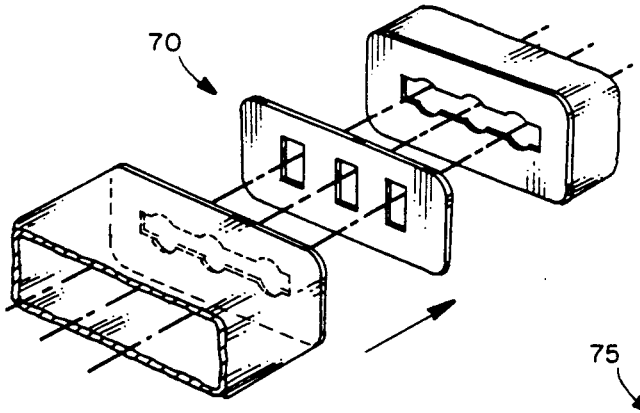

The dynamic quadrupole lens 55 of FIG. 8 is a combination of the lenses shown in FIGS. 2 and 9 in that the second electrode 57 includes three circular, or elliptically shaped, apertures 57*a*, 57*b* and 57*c*, while the first and third electrodes 56 and 58 each include respective elongated, horizontally oriented apertures 56*a* and 58*a*. Each of the apertures 56*a* and 58*a* includes a plurality of spaced enlarged portions through which a respective one of the electron beams is directed. The dynamic quadrupole lenses 65 and 70 respectively shown in FIGS. 10 and 11 also include three spaced electrodes in alignment with three electron beams, wherein the electrodes include various combinations of apertures previously described and illustrated. In FIG. 10, the first and third electrodes 66 and 67 are each shown with a plurality of spaced elongated apertures having their longitudinal axes in common alignment with the inline electron beams.

Figure 12:
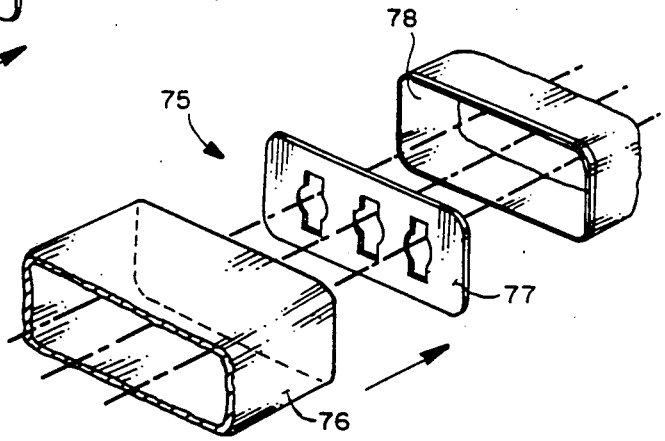
Figure 13:
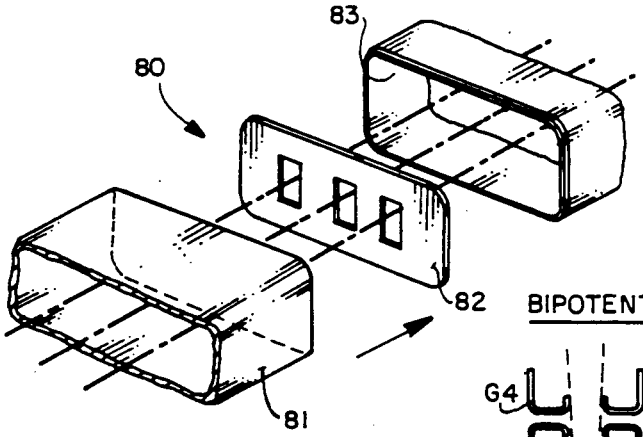

Referring to FIG. 12, there is shown yet another embodiment of a dynamic quadrupole lens 75 in accordance with the principles of the present invention. The dynamic quadrupole lens 75 includes first and third electrodes 76 and 78, which are each in the general form of an open frame through which the electron beams pass, and a second electrode 77 having three spaced, generally vertically oriented apertures through each of which a respective one of the electron beams is directed. The first and third electrodes 76 and 78 do not include an aperture through which electron beams are directed, or may be considered to have an infinitely large aperture disposed within a charged electrode. At any rate, it has been found that it is the dynamic focusing voltage applied to the first and third electrodes 76 and 78 which functions in combination with the charge on the second electrode 77, and the apertures therein, to provide electron beam convergence/divergence control in compensating for electron beam astigmatism and defocusing. The dynamic quadrupole lens 80 of FIG. 13 is similar to that shown in FIG. 12, except that the three apertures in the second electrode 82 are generally rectangular in shape and operate in conjunction with the first and third dynamically charged electrodes 81 and 83.

The dynamic quadrupole lens 75 operates in the following manner. In a COTY-type CRT, the second electrode 77 will be at a higher voltage than the first and third electrodes 76, 78 when the electron beams are positioned near the center of the CRT screen. The second electrode 77 will thus cause a horizontal divergence resulting in a negative astigmatism correction as shown in FIG. 5*a*. The first and third electrodes 76, 78 cause a vertical convergence of the electron beams to further effect negative astigmatism correction. When the electron beams are adjacent to a lateral edge of the CRT screen, the second electrode 77 will be at a lower voltage than the first and third electrodes 76, 78 resulting in horizontal convergence and vertical divergence of the electron beams as shown in Table I and as illustrated in FIG. 5*b* as a positive astigmatism correction. Thus, electron beam astigmatism and defocusing are corrected for by the dynamic quadrupole lenses of FIGS. 12 and 13, although the compensating effects of this electrode arrangement are not as great as in the previously discussed embodiments wherein all three electrodes are provided with apertures.

Figure 14A:
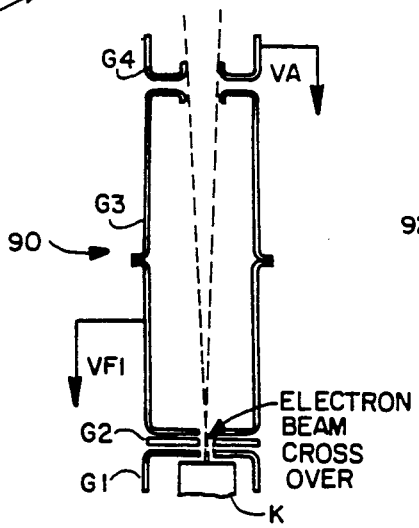
FIGS. 14*a* and 14*b* respectively illustrate sectional views of a prior art bipotential type ML electron focusing lens and the manner in which the dynamic quadrupole lens of the present invention may be incorporated in such a prior art electron beam focusing lens.

Referring to FIG. 14*a*, there is shown a conventional bipotential type main lens (ML) electron gun 90. The bipotential type ML electron gun 90 includes a cathode K which provides electrons to the combination of a control grid electrode G1, a screen grid electrode G2, a first accelerating and focusing electrode G3, and a second accelerating and focusing electrode G4. A focusing voltage $VF_1$ is applied to the first accelerating and focusing electrode G3, and an accelerating voltage $V_A$ as applied to the second accelerating and focusing electrode G4.

Figure 14B:
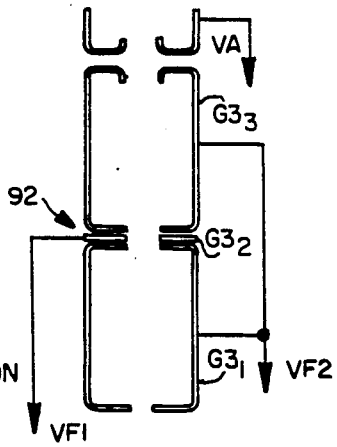

FIG. 14*b* shows the manner in which a dynamic quadrupole lens 92 may be incorporated in a conventional bipotential type ML electron gun. The dynamic quadrupole lens 92 includes adjacent plates of a $G3_1$ electrode and a $G3_3$ electrode to which a dynamic focusing voltage VF2 is applied. The dynamic quadrupole lens 92 further includes a $G3_2$ electrode, or grid, which is maintained at a fixed voltage VF1. The cathode as well as various other control grids which are illustrated in FIG. 14*a* have been omitted from FIG. 14*b*, as well as the remaining figures, for simplicity. Thus, a bipotential type ML electron gun may be converted to an electron gun employing the dynamic quadrupole lens of the present invention by separating its first accelerating and focusing electrode G3 into two components and inserting a third fixed voltage electrode $G3_2$ between the two accelerating and focusing electrode components $G3_3$ and $G3_1$.

Figures 15A, 15B:
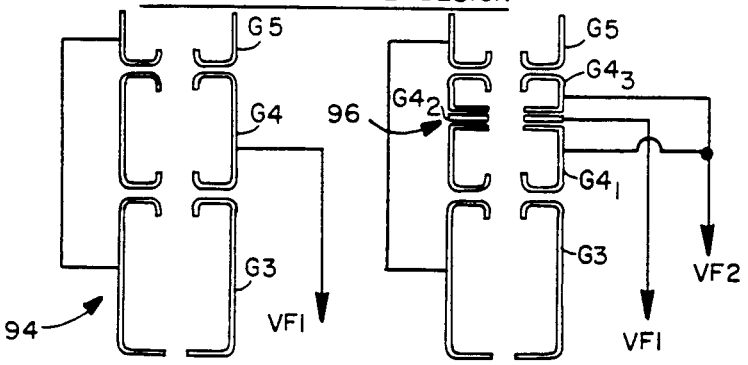
FIGS. 15*a* and 15*b* are sectional views of a prior art Einzel-type ML electron focusing lens and the same focusing lens design incorporating a dynamic quadrupole lens in accordance with the present invention, respectively.

Referring to FIG. 15*a*, there is shown a conventional Einzel-type ML electron gun 94 which includes G3, G4 and G5 accelerating and focusing electrodes.

Referring to FIG. 15*b*, there is shown the manner in which a dynamic quadrupole lens 96 in accordance with the present invention may be incorporated in a conventional Einzel-type ML electron gun. In the electron gun arrangement of FIG. 15*b*, the G4 electrode is divided into two lens components $G4_1$ and $G4_3$, and a third focusing electrode $G4_2$ is inserted between the adjacent charged plates of the $G4_1$ and $G4_3$ electrodes. A fixed focus voltage VF1 is applied to the $G4_2$ electrode, while a dynamic focus voltage VF2 is applied to the $G4_1$ and $G4_3$ electrodes. The dynamic quadrupole lens 96 within the Einzel-type ML electron gun thus includes adjacent charged plates of the $G4_1$ and $G4_3$ accelerating and focusing electrodes in combination with an intermediate $G4_2$ electrode which is maintained at a fixed focus voltage VF1.

Figures 16A, 16B, 16C, 16D:
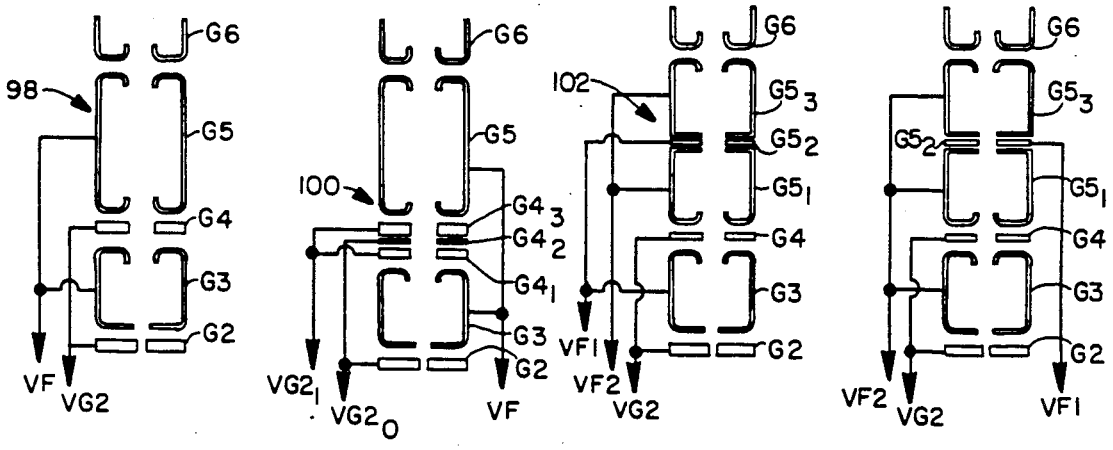
FIGS. 16*a*, 16*b*, 16*c* and 16*d* respectively illustrate sectional views of a prior art QPF-type ML electron focusing lens and three versions of such a QPF-type ML lens incorporating a dynamic quadrupole lens in accordance with the present invention.

Referring to FIG. 16*a*, there is shown a conventional QPF type ML electron gun 98. The QPF type ML electron gun 98 includes G2, G3, G4, G5 and G6 electrodes. A fixed focus voltage VF is applied to the G3 and G5 electrodes.

FIG. 16*b* illustrates the manner in which a dynamic quadrupole lens 100 in accordance with the present invention may be incorporated in the G4 electrode of a QPF type ML electron gun. In the arrangement of FIG. 16*b*, the G4 electrode is comprised of $G4_1$, $G4_2$ and $G4_3$ electrodes. The G2 and $G4_2$ electrodes are maintained at a voltage $VG2_0$, while the $G4_1$ and $G4_3$ electrodes are maintained at a voltage $VG2_1$. The $VG2_0$ voltage is fixed, while the $VG2_1$ voltage varies synchronously with electron beam sweep across the CRT screen.

Referring to FIG. 16*c*, there is shown the manner in which a dynamic quadrupole lens 102 in accordance with the present invention may be incorporated in the G5 electrode of a conventional QPF type ML electron gun. In the arrangement of FIG. 16*c*, the G5 accelerating and focusing electrode of a conventional QPF type ML electron gun has been divided into three control electrodes $G5_1$, $G5_2$ and $G5_3$. A fixed focus voltage VF1 is applied to the G3 and $G5_2$ electrodes, while a dynamic focus voltage VF2 is applied to the $G5_1$ and $G5_3$ electrodes. A VG2 voltage is applied to the G2 and G4 electrodes. The dynamic quadrupole lens 102 is comprised of the $G5_2$ electrode in combination with the adjacent plates of the $G5_1$ and $G5_3$ electrodes. In FIG. 16*d*, the G3 electrode is shown coupled to the VF2 focus voltage rather than the VF1 focus voltage as in FIG. 16*c*. In the arrangement of FIG. 16*d*, two spatially separated quadrupoles each apply an astigmatism correction to the electron beams. A first quadrupole is comprised of the upper plate of the G3 electrode, the lower plate of the $G5_1$ electrode, and the G4 electrode disposed therebetween. A dynamic focus voltage VF2 is provided to the G3, $G5_1$ and $G5_3$ electrodes. The second quadrupole is comprised of the upper plate of the $G5_1$ electrode, the lower plate of the $G5_3$ electrode, and the $G5_2$ electrode disposed therebetween. The $G5_3$ and G6 electrodes form an electron beam focusing region, while the combination of electrodes G2 and G3 provide a convergence correction for the two outer electron beams as the beams are swept across the CRT screen with changes in the electron beam focus voltage. This is commonly referred to as a FRAT (focus refraction alignment test) lens.

Figures 17A, 17B:
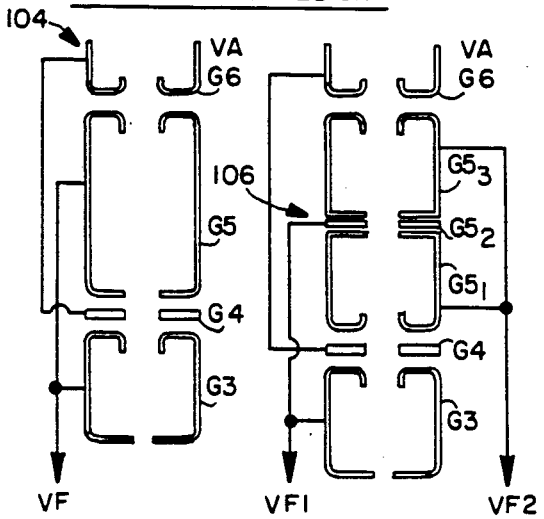
FIGS. 17*a* and 17*b* respectively illustrate sectional views of a prior BU-type ML electron focusing lens and the same type of electron focusing lens incorporating the inventive dynamic quadrupole lens of the present invention.

Referring to FIG. 17*a*, there is shown a conventional BU type ML electron gun 104. The BU type ML electron gun 104 includes G3, G4, G5 and G6 electrodes. An anode voltage VA is applied to the G4 and G6 electrodes, while a dynamic focus voltage VF is applied to the G3 and G5 electrodes.

FIG. 17*b* shows the manner in which a dynamic quadrupole lens 106 in accordance with the present invention may be incorporated in a conventional BU type ML electron gun. The G5 electrode of the prior art BU type ML electron gun is reduced to two electrodes $G5_1$ and $G5_3$, with a third electrode $G5_2$ inserted therebetween. The dynamic quadrupole lens 106 thus is comprised of adjacent plates of the $G5_1$ and $G5_3$ electrodes in combination with the $G5_2$ electrode. A fixed focus voltage VF1 is applied to the G3 and $G5_2$ electrodes, while the anode voltage VA is applied to the G4 and G6 electrodes. A dynamic focusing voltage $VF_2$ is applied to the $G5_1$ and $G5_3$ electrodes in the electron gun.

THE PRESENT INVENTION

As discussed above, in order to achieve three electron beam dynamic convergence at the CRT display screen corners, the self-converging magnetic deflection yoke fields over focus the beams in the vertical direction and under focus them in the horizontal direction. The electron gun system of the present invention provides self-convergence for the three electron beams in a similar manner, i.e., over focusing in the vertical direction and under focusing in the horizontal direction, to effect of substantially reducing electron beam astigmatism inherent in the operation of the self-converging inline deflection yoke design. The electron beam convergence provided by the electron gun system of the present invention is sufficient to reduce and possibly eliminate the requirement of a self-converging deflection yoke and to permit the electron gun system to be used with a simpler uniform field yoke. This is preferably accomplished in the present invention by modifying the two outer apertures through which the outer electron beams are directed so as to reduce the electrostatic field strength in a direction away from the center aperture causing the two outer electron beams to be deflected outwardly. The electrostatic field applied to the two outer electron beams is weakened in an outward direction by providing two outer electron beam passing apertures with lateral, outer notches to provide an electrostatic field with the required asymmetry. An electron gun incorporating the principles of the present invention may also incorporate a dynamic focusing capability as well as a dynamic quadrupole arrangement for astigmatism correction. The self-convergent electron gun system of this invention may also be incorporated in a common lens type of inline electron gun, such as of the COTY type, as well as in virtually any type of non-COTY gun having separate electrode apertures for each of the beams. The present invention utilizes offset dynamic electron beam bending to enhance electron gun focus-convergence interaction to provide as much as half of the self-convergence required in an inline electron gun system (approximately 1.5 mm per gun in a 27 inch-110° tube).

This invention contemplates an electron gun system having a focusing lens in which changes in focusing field strength alter electron beam convergence producing dynamic beam convergence, in combination with convergence means employing asymmetrical beam passing apertures for the two outer beams producing additional dynamic convergence which is additively combined with the dynamic convergence effect produced by the focusing lens. The present invention may be incorporated in a horizontally unbalanced quadrupole utilized for dynamic convergence. In both cases, the inventive electron gun system provides dynamic convergence which additively combines with the focusing effect of other electron gun elements. An additional increment of dynamic convergence may be provided by a yoke which is partially self-converging.

In one embodiment to be described (FIGS. 19–27), a novel electrode has a center opening and two outer openings arranged inline along an electrode horizontal axis orthogonal to the gun axis. The outer openings have profile distortions which are symmetrical about the electrode horizontal axis and a vertical axis through the center opening, but asymmetrical about respective vertical axes through the outer beam openings. In one preferred embodiment, the opening profile distortions each take the form of an outwardly extending opening enlargement (a notch, for example).

The invention is preferably used in a system having unipotential (Einzel) type quadrupolar lenses, or quadrupolar lenses of the bipotential or other type. The profile distortion provided to create the field asymmetry for the off-axis beams may be located in the electrode or electrodes having relatively lower voltage, with the profile enlargement extending away from the center beam opening, or in the electrode or electrodes having relatively higher voltage, with the profile enlargement extending inwardly toward the center beam opening.

In a broader context, the invention utilizes a lens for an electron gun having the capability of bending a beam passing through the lens, independent of the application or manner of the center beam opening, or in the electrode or electrodes having relatively higher voltage, with the profile enlargement extending inwardly toward the center beam opening.

In a broader context, the invention utilizes a lens for an electron gun having the capability of bending a beam passing through the lens, independent of the application or manner of implementing the lens. In this context, the invention concerns the provision of an electron lens having at least two facing apertured electrodes, one adapted to receive a relatively higher excitation potential and the other a relatively lower excitation potential, the electrodes being constructed and arranged such that an electrostatic focusing field component is created therebetween for the beam when different excitation potentials are applied to the facing electrodes. The electron lens includes means for unbalancing the focusing field component such as to cause the beam to be diverted from a straight line path as a function of the different applied potentials. The unbalancing, as described, is preferably by provision of an asymmetrical field component in the lens which, in turn, is preferably created by the provision of an aperture pattern in one of the facing electrodes, all as outlined above and as will be described in detail hereinafter.

Such an electron lens with beam bending capability may be employed in electron guns in general, but not limited to the type described above and to be described hereinafter wherein the lens provides dynamic electron beam convergence which supplements the dynamic convergence effect produced by a focusing lens to reduce the amount of self-convergence needed from the inline yoke system and reduce undesirable self-convergence yoke effects on the deflected beams.

In still a broader context, this invention utilizes an improved means for electrically bending or diverting the path of an electron beam, independent of its use in a quadrupolar or any other particular type of lens. In the background of the invention set forth above, mention is made of three types of electron-refractive devices which each create an asymmetrical field in the path of an electron beam to divert it from a straight line path. One employs offset apertures, another an angled electrode gap, and a third a wedge-shaped gap between the operative electrodes. Applicants here provide a fourth way—namely, by the provision of an aperture pattern in one or both of a pair of facing electrodes which is so shaped relative to the aperture pattern in the facing electrode as to create an asymmetrical field influencing the passed electron beams. Thus the beam bender may be used in substitution for any of the above three types of beam benders in any application in which they are found, as well as other applications which call for electrical beam convergence. The present invention has the advantage over the afore-discussed three types of beam benders found in the prior art in that it is more easily mandrelled during electron gun assembly than any of those arrangements.

Such a beam bender may be adapted for dynamic convergence by employing it on the off-axis beams and applying a varying potential to one or both of the operative facing electrodes to cause the strength of the asymmetrical field to vary as a function of the applied voltage. In application to a three beam inline gun color CRT having dynamic convergence, a variable voltage correlated with the deflection of the beam across the screen may be applied to one or all of the electrodes. The use of a beam bender for dynamic beam convergence, with or independent of a quadrupolar lens, is claimed and described in our co-pending application, Ser. No. 521,505.

The present invention can be applied to electron gun systems of several different types, both unitized and non-unitized. However, the illustrated embodiments according to the invention are in the form of inline unitized guns as these types are in more general use in color cathode ray tubes. The convergence means according to the invention is applicable to color tubes of various types including home entertainment television tubes, and to medium-resolution and high-resolution tubes used in color monitors.

Figure 18:
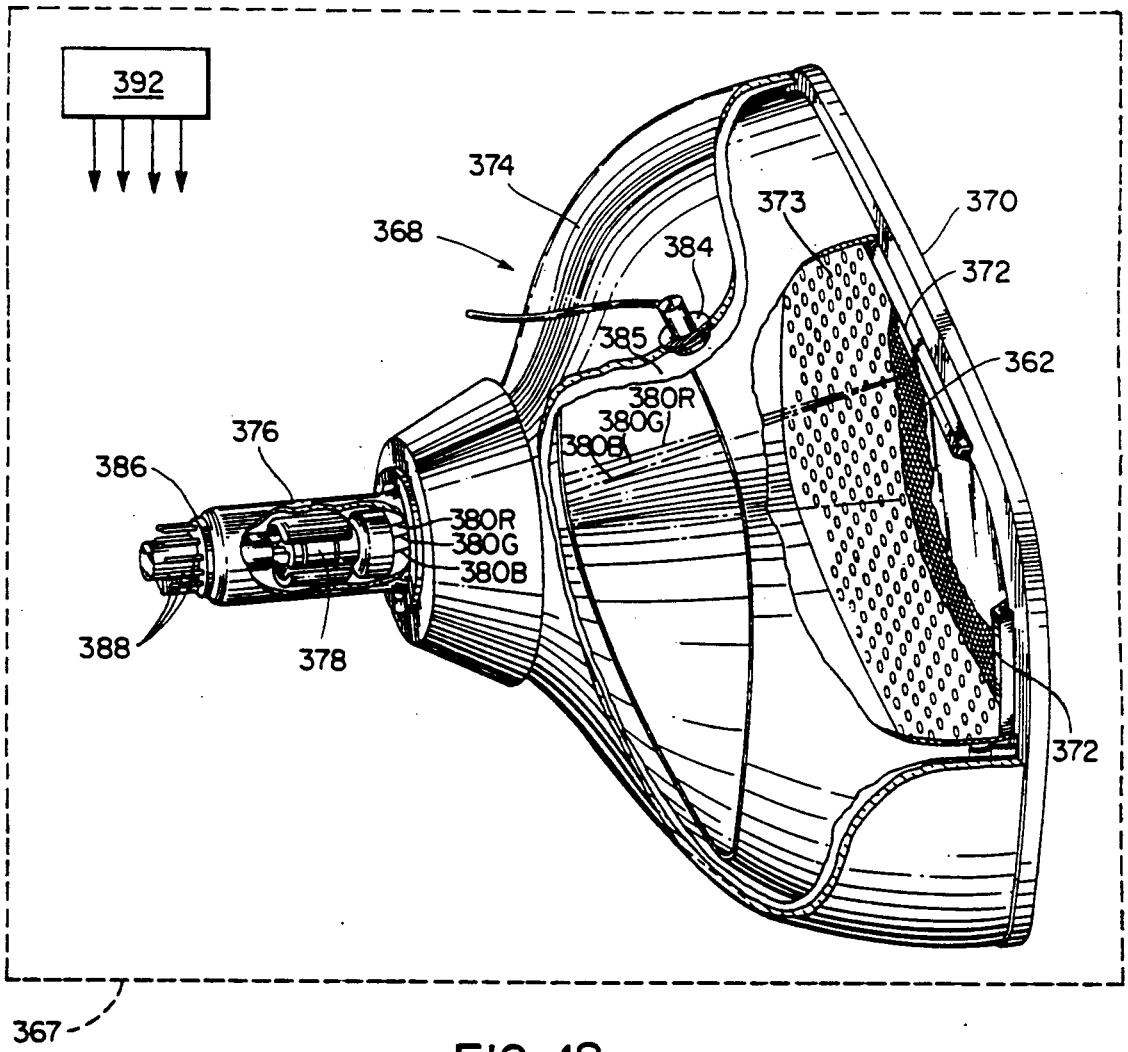
FIG. 18 is a view in elevation and partially in section of a cathode ray tube having a planar shadow mask and associated flat faceplate, with a television system or display system represented schematically by the enclosing dashed line, and in which the electron gun system according to the invention can be utilized.

A color cathode ray tube (CRT) system in which the self-convergent electron gun system of the present invention is intended for use is depicted in FIG. 18. The CRT system 367 is indicated in FIG. 18 as including a color cathode ray tube 368 with a substantially flat glass faceplate 370. A shadow mask support frame 372 is represented as being attached to faceplate 370 for supporting a shadow mask 373. Faceplate 370 is joined to a rear envelope section of tube 368, here shown as funnel 374 which tapers down to a narrow neck 376. Neck 376 is shown as enclosing a three-beam, inline electron gun 378 which is indicated as projecting three electron beams 380R, 380G and 380B onto the inner surface of faceplate 370, comprising a phosphor screen 382. Screen 382 comprises a pattern of phosphor elements consisting of three compositions of phosphors deposited thereon which emit red, green and blue light when excited by the respective electron beams 380R, 380G and 380B. An anode button 384, which is in contact with a conductive coating 385, provides for the entry into the tube envelope of a high electrical potential for tube operation. Relatively lower electrical potentials for operation of the electron gun 368 are conducted through the tube base 386 by means of a plurality of conductive pins 388. As shown by FIG. 18, a yoke means 390, preferably being a uniform field yoke or a limited self-converging yoke, provides for deflecting the electron beams 380R, 380G and 380B across the screen 382 of faceplate 370 to selectively excite the phosphors deposited thereon through the foraminous medium of the shadow mask 373.

The three electron beams 380R, 380G and 380B of tube 374 are caused to scan a raster on the respective phosphor deposits on screen 382. The beams are modulated; that is, the beam currents are varied to form the picture. Beam scanning is a product of horizontal and vertical scansion circuits by which scanning signals are applied to the yoke of the tube, all as is well known in the art.

The circuits that provide potentials for cathode activation, beam scanning, and beam luminance, and which form field components in the gaps between adjacent electrodes, are indicated schematically by block 392. As has been noted, the potentials are applied to the gun components by way of the several conductive pins 388. An ancillary circuit also provides the single dynamic signal required for control of the operating parameters of the electron gun, as will be described.

As noted, the potentials are normally conducted to the electrodes of the electron gun 378 through selected ones of the electrically conductive pins 388 that pass in airtight seal through electrically insulative base 386 of tube 368. A very high potential (e.g., 20–30 kV) applied to the final, or "anode", electrode is typically routed through the anode button 384 in the tube envelope to the conductive coating 385 on the inner surface of the funnel 374. The potential is then conducted to the final, anode electrode by a plurality of guncentering springs (not shown), typically three in number, that make contact with the conductive coating, and which extend from a cup-shaped electrode (also not shown).

Figure 21:
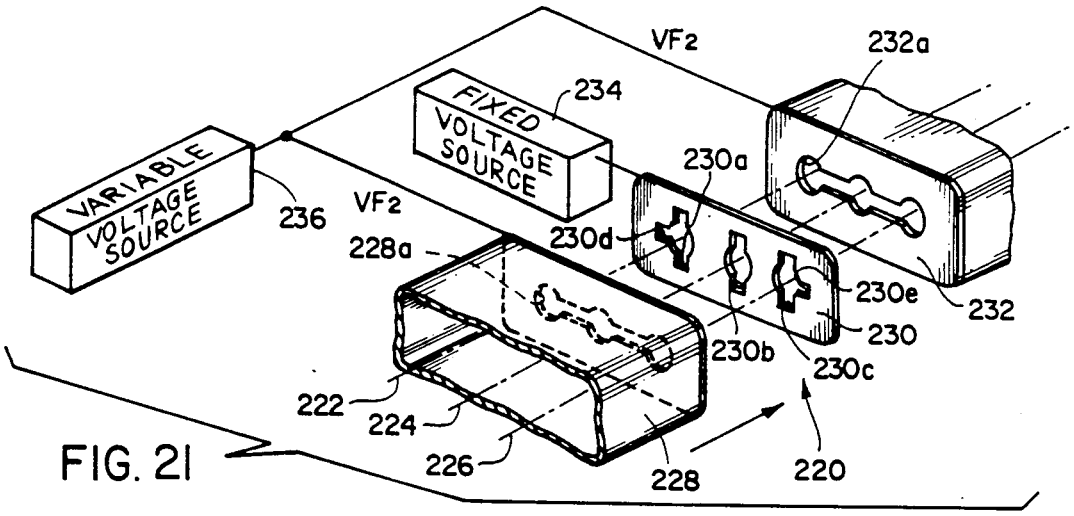
FIG. 21 is a perspective view of an electron beam misconvergence correction arrangement in accordance with the present invention as employed in a dynamic quadrupole lens for an inline color CRT.

Referring to the perspective view of FIG. 21, there is shown a portion of a self-convergent electron gun with dynamic focus control 220 in accordance with the present invention incorporating a dynamic quadrupole lens with a second electrode 230 for use in a color CRT in accordance with the present invention. The dynamic quadrupole lens includes first, second and third electrodes 228, 230 and 232 arranged in mutual alignment. The first electrode 228 includes an elongated aperture **228*a* extending a substantial portion of the length of the electrode. Disposed along the length of the aperture 228*a* in a spaced manner are three openings in the form of enlarged portions of the aperture. As in the case of the first electrode 228, the third electrode 232 also includes an elongated aperture 232*a* extending along a substantial portion of the length thereof and including three spaced openings in the form of enlarged portions of the aperture 232*a*. The first and third electrodes 228 and 232 are aligned so that first, second and third electron beams 222, 224 and 226 respectively transit the corresponding enlarged portions of the elongated apertures 228*a* and 232*a* within the first and third electrodes. The first and third electrodes 228, 232 are coupled to a variable voltage source 236** for applying a dynamic voltage $VF_2$ to these electrodes.

The second electrode 230 is disposed intermediate the first and third electrodes 228, 232 and includes three keyhole-shaped apertures **230*a*, 230*b* and 230*c* arranged in a spaced manner along the length of the electrode. Each of the aforementioned keyhole-shaped apertures 230*a*, 230*b* and 230*c* has a longitudinal axis which is aligned generally vertically as shown in FIG. 21, or generally transverse to the longitudinal axes of the apertures in the first and third electrodes 228 and 232. With the first, second and third electrodes 228, 230 and 232 arranged generally parallel in a linear alignment, the respective apertures of the electrodes are adapted to allow the transit of the three electron beams 222, 224 and 226, each shown in the figure as a dashed line. The second electrode 230 is coupled to a constant voltage source 234** and is charged to a fixed potential $VF_1$. The electrodes are physically retained in precise relationship one with the other by glass multiforms which are not shown for the sake of simplicity.

Figure 19:
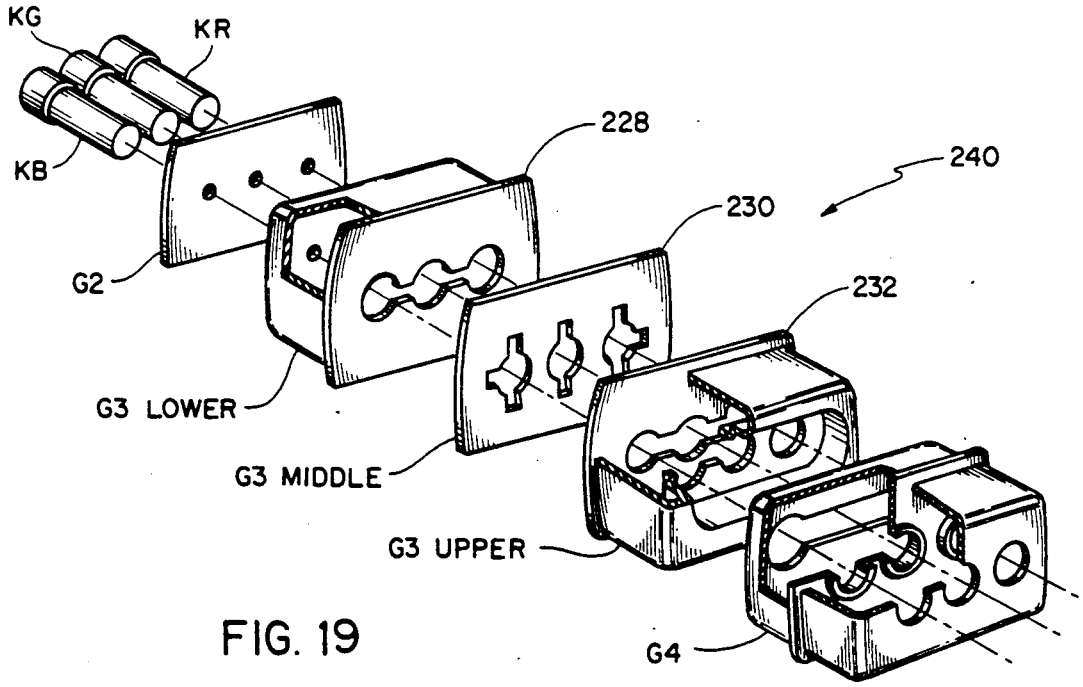
FIG. 19 is an exploded view in perspective and partially cut away that shows the relationship of the components of a three-beam electron gun according to the invention.
Figure 20:
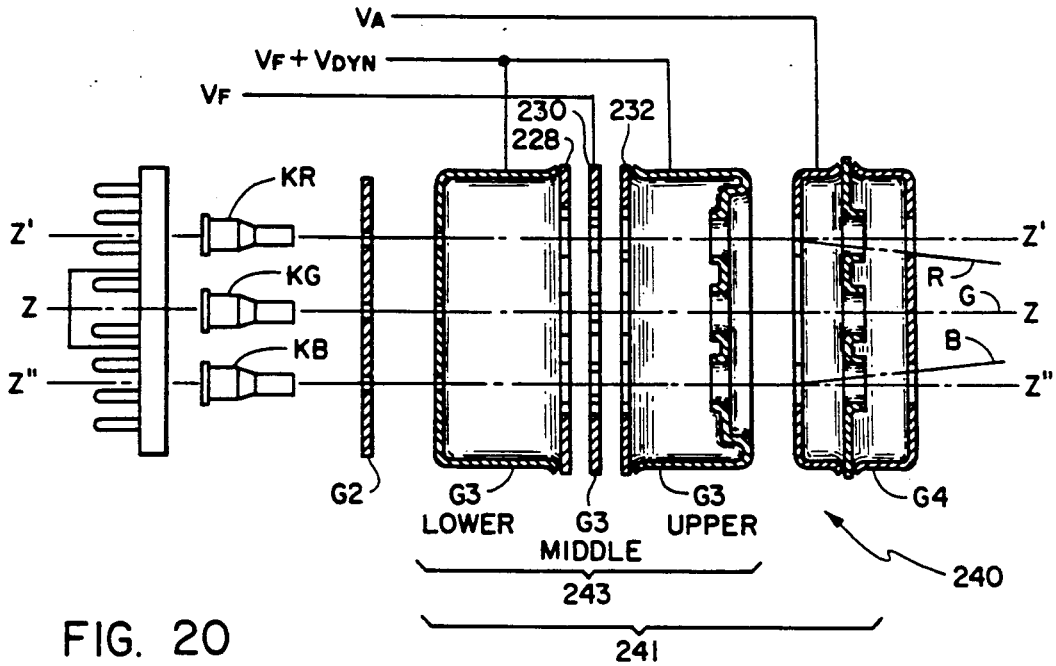
FIG. 20 is a schematized top view of the electron gun depicted in FIG. 19.
Figure 22:
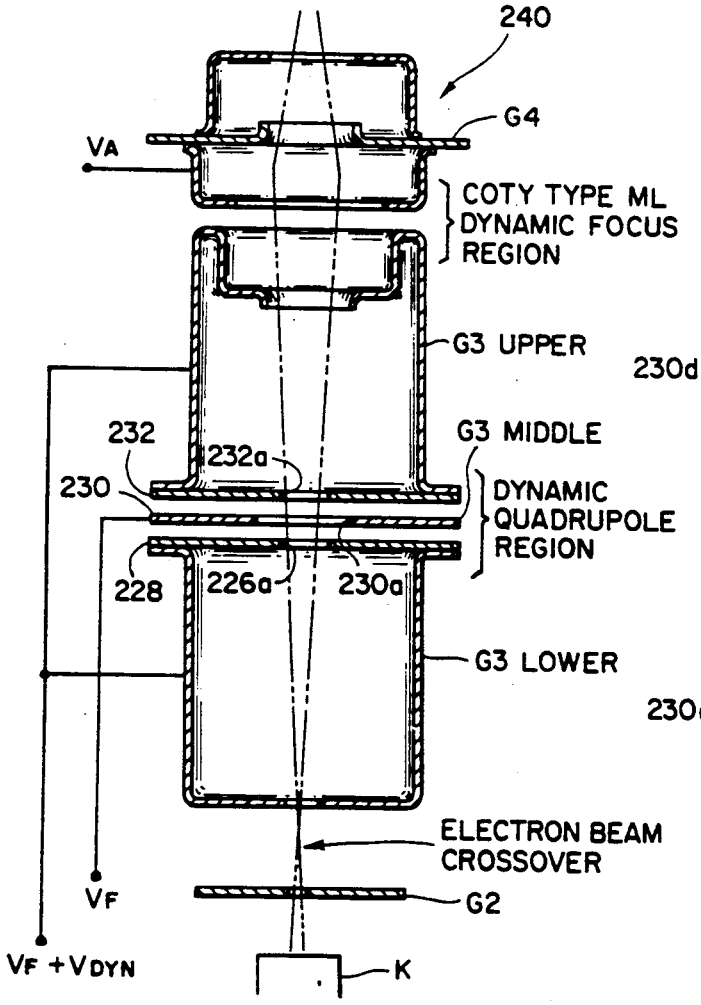
FIG. 22 is a lengthwise sectional view of an electron beam misconvergence correction arrangement as shown in FIG. 20.
Figure 24:
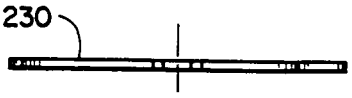
FIG. 24 is an end-on view of the focusing electrode of FIG. 23.
Figure 23:
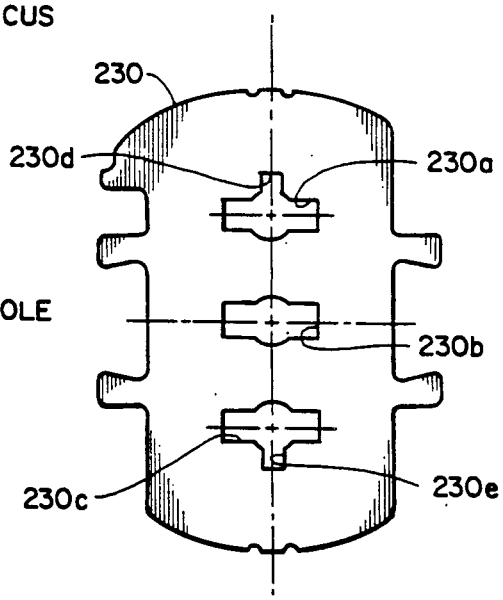
FIG. 23 is a plan view of an offset keyhole electrode design for use in an inline multi-electron beam focusing arrangement in an electron gun in accordance with the present invention.

Referring also to FIGS. 19, 20 and 22, an electron gun 240 having a quadrupole focusing type main lens (ML) and incorporating a dynamic focus control 220 as shown in FIG. 21 will now be described. Each of the three keyhole-shaped apertures 230*a*, 230*b* and 230*c* in the second electrode 230 includes an enlarged center portion through which a respective one of the electron beams is directed. As shown in the figures, the two outer keyhole-shaped apertures 230*a* and 230*c* are provided with respective opening profile distortions or opening enlargements in the form of notches 230*d* and 230*e* on outer portions thereof and are in the general form of an offset keyhole. The opening enlargements (here notches) 230*d* and 230*e* in the offset keyhole-shaped apertures 230*a* and 230*c* unbalance the horizontal focusing strength of the two outer offset keyholes to produce an asymmetrical field component having a refraction lens effect, where the strength of the refraction lens on the two outer electron beams is proportional to the dynamic drive voltage $V_{DYN}$ applied to the first and third electrodes 228 and 232. The refraction lens effect of the notched outer portions of the two outer keyhole-shaped apertures 230*a* and 230*c* moves the outer (here red and blue) electron beams outwardly along the horizontal direction across the CRT's faceplate to reduce the amount of self-convergence needed from the inline yoke system and reduce undesirable self-convergence yoke effects on the deflected beam, such as beam over focusing in the vertical direction and under focusing in the horizontal direction. The notches 230*d* and 230*e* reduce the strength of the electrostatic field applied to the two outer electron beams resulting in outward deflection of the two outer electron beams. The outer electron beams are horizontally displaced outwardly with the second electrode 230 maintained at a lower voltage than the first and third electrodes 228 and 232.

As particularly shown in the sectional view of FIG. 22, the first, second and third electrodes 228, 230 and 232 form a dynamic quadrupole to compensate for electron beam astigmatism and defocusing caused by the electron beam deflection yoke. A fixed focusing voltage $V_{F1}$ is applied to the second electrode 230 while a dynamic focusing voltage $V_{F2}+V_{DYN}$ is applied to the first and third electrodes 228 and 232. A cathode K emits electrons which are controlled by various grids including a screen grid electrode G2. The electrons are then directed to a first accelerating and focusing electrode G3. The G3 electrode is comprised of a G3 lower section, a G3 upper section, and the aforementioned dynamic quadrupole region disposed therebetween. The respective apertures 228*a*, 230*a* and 232*a* in the first, second and third electrodes 228, 230 and 232 are aligned to allow the transit of each of the three electron beams as discussed above and shown in FIG. 21. A second accelerating and focusing electrode G4 is disposed adjacent to the G3 upper portion, with a COTY type main lens (ML) dynamic focus region (or stage) formed by the G3 and G4 electrodes.

While a second electrode 230 having a pair of outer keyhole-shaped apertures 130*a* and 130*c* each with an outer notch is disclosed and illustrated herein as forming a portion of a dynamic quadrupole electron beam focusing lens, as noted above, the opening profile distortion feature of the present invention is not limited to use in a dynamic quadrupole lens and may be used simply by itself in virtually any type of conventional electron gun. Even when not used in a dynamic quadrupole lens, the offset keyhole design of the inventive focusing electrode 230 exerts a refractive lens effect on the off-axis (outer) electron beams, with the strength of the refraction (asymmetrical) lens being proportional to the dynamic focusing voltage applied to the main lens focusing stage, to horizontally displace the outer (here red and blue) beams so as to provide electron beam convergence and reduce the undesirable self-convergence yoke effects such as astigmatism. When not employed in a quadrupole electron beam focusing lens, the inventive electrode 230 is disposed intermediate the G3 lower and upper electrode portions, with the first and third electrodes 228, 232 absent from such an electron beam focusing arrangement.

The electron gun 240 has means including three cathode means KR, KG and KB for developing three inline electron beams R (red), G (green) and B (blue). The three beams are shown as initially being projected in parallelism with the center axis X—X' of gun 240 except when the two outer beams are caused to diverge. The means for developing the three electron beams is commonly referred to as the "prefocusing section," which includes the three cathode means KR, KG and KB, and the G2 accelerating grid and a control grid which is not shown for simplicity. The three beams are generated by thermionic emission of the cathode means, as is well known in the art.

Three focus lens means provide for receiving the three inline beams R, G and B for forming three focused electron beam spots at the screen of the tube. The focus lens means each have a plurality of electrode means spaced along a lens axis parallel to the other lens axes and parallel to the gun center axis X—X'. At least two of the lens axes, shown as being two lens axes Y—Y' and Z—Z', are off-axis with respect to the gun central axis X—X'. Center beam G is noted as being in alignment with the gun center axis X—X'. Please note also that the term "focus lens means" refers to the focus lens structure employed to focus all the beams; this group of lens means bears reference number 241. The term "focus electrode means" refers to a discrete individual focus electrode for a single beam, or an allotted portion of a unitized electrode common to others of the beams. The focus lens means 241 depicted in the figures is a four element quadrupolar lens as previously described.

Focus lens means 241 is represented as including a focus electrode means 243, indicated as comprising the G3 lower, G3 middle and G3 upper electrodes. The G4 electrode is also referred to as an "anode electrode" or "accelerating electrode," as it receives a high voltage $V_A$ for beam acceleration toward the CRT screen.

Figure 25:
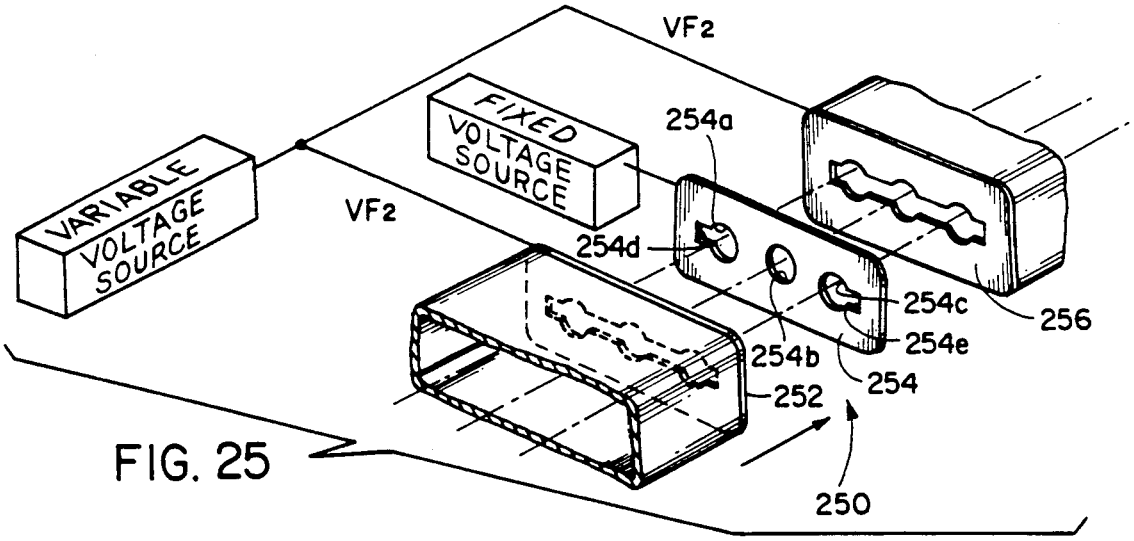
FIG. 25 is a perspective view of an electron beam misconvergence correction arrangement incorporating generally circular, notched outer apertures in a center electrode in accordance with another embodiment of the present invention.

FIG. 25 is a perspective view of another embodiment of an electron beam self-convergence and dynamic focus arrangement 250 incorporating a dynamic quadrupole and including first, second and third electrodes 252, 254 and 256. The second (middle) electrode 254 includes three generally circular spaced apertures 254*a*, 254*b* and 254*c*. The outer two apertures 254*a* and 254*c* include respective outwardly opening enlargements in the form of directed notches 254*d* and 254*e*. These notches provide an unbalanced horizontal focusing field to produce the refraction lens effect, where the strength of the refraction lens on the two outer electron beams is proportional to the dynamic drive voltage applied to the first and third electrodes 252 and 256. The second electrode 254 is introduced for use in a lens arrangement wherein it receives a lower applied potential.

Figure 26:
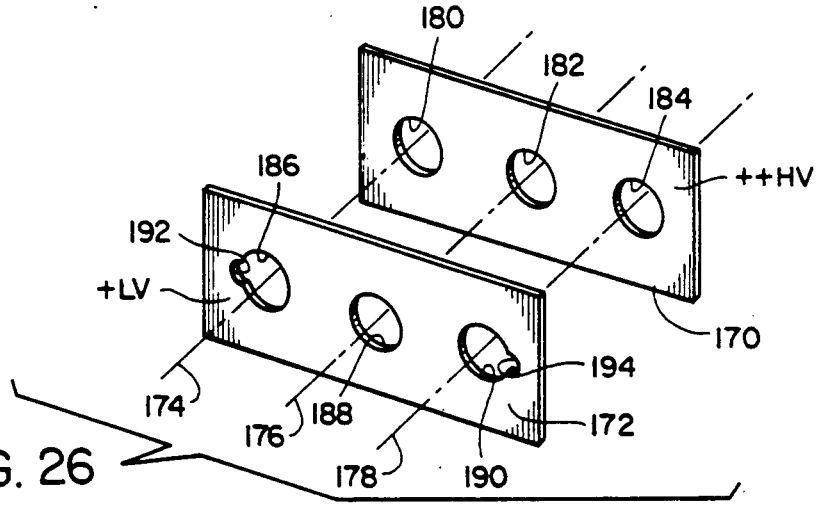
FIG. 26 is a schematic illustration of a focusing lens structure in a three-beam inline gun wherein the outer electron beams are electrically converged by the present invention.

As suggested above, the present invention can be viewed in a broad context as providing means for electrically refracting or bending an electron beam in various applications in electron guns not limited to the preferred embodiments described above. FIG. 26 is a schematic illustration of the use of a focusing lens structure in a three-beam inline gun in which the outer beams are electrically converged by use of the present invention. Specifically, FIG. 26 illustrates a pair of facing electrodes 170, 172 for converging three electron beams 174, 176 and 178. Electrode 170 has apertures 180, 182 and 184 which cooperate with apertures 186, 188 and 190 in adjacent electrode 172. Electrode 172 is adapted to receive a relatively lower potential and electrode 170 is adapted to receive a relatively higher potential.

Also in accordance with the present invention, the electrode 172 receiving the relatively lower potential has an aperture pattern so configured so as to create symmetrical field components for the outer beams 174, 178 which have the effect of bending or refracting the outer beams 174, 178 outwardly away from the center electron beam.

As explained in more detail and claimed in our copending application, Ser. No. 521,505, a dynamic voltage may be applied to one or both of the electrodes 170, 172 to cause the beam convergence angle to vary as a function of beam deflection.

In accordance with the present invention, the asymmetrical field component acting upon the outer beams 174, 178 is produced by enlarging the apertures 186, 190 in a direction outwardly away from the center aperture 188. The opening enlargements are shown as taking the form of rounded protuberances 192, 194, respectively, in the profile of the apertures 186, 190. Many other opening distortion geometries may be utilized in accordance with the present invention, dependent upon the nature and degree of unbalancing of the fields on the outer beams which is desired.

Figure 27:
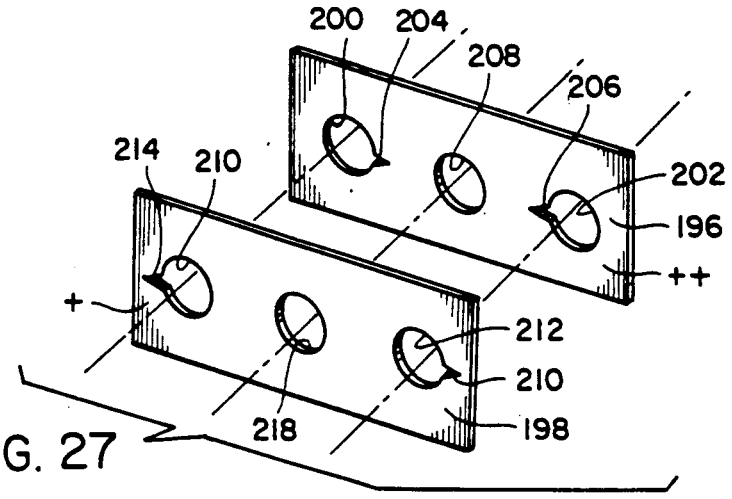
FIG. 27 is a simplified schematic diagram of yet another embodiment of the present invention wherein an asymmetric field component is formed by distorting the outer beam apertures in a pair of adjacent focusing electrodes maintained at different voltages.

FIG. 27 illustrates yet another embodiment of the present invention wherein the asymmetrical field component is formed by distorting the openings for the outer beams in both electrode 196 receiving a relatively higher voltage and electrode 198 receiving a relatively lower voltage. Specifically, the electrode 196 has outer beam passing openings 200, 202 which have opening enlargements 204, 206 extending inwardly toward the center beam opening 208. The electrode 198 adapted to receive the lower potential has outer beam apertures 210 and 212 having opening enlargements 214, 216 which extend outwardly away from the center beam opening 218. The FIG. 27 embodiment illustrates that opening enlargements may be employed in both the high voltage and lower voltage electrodes as well as only in the lower voltage electrode and that these opening enlargements may assume various forms.

There has thus been shown an electron gun system having a beam focusing lens which changes the focusing field strength for effecting dynamic convergence of the beams for use with convergence means employing asymmetrical apertures for the two outer beams. The convergence means additively supplements the dynamic convergence effect of the focusing lens for improved electron beam focusing. The partial dynamic convergence of the focusing lens in combination with convergence means is adapted for use with either a partially self-converging yoke or a uniform field yoke. The convergence means of the present invention may be incorporated in a horizontally unbalanced quadrupole also for use with a partially self-converging yoke, the convergence effects of which combine additively.

While particular embodiments of the present invention have been shown and described, it will be obvious to those skilled in the art that changes and modifications may be made without departing from the invention in its broader aspects. For example, while the present invention has been described as applying a dynamic voltage to first and third electrodes and a fixed voltage to a second electrode spaced therebetween, this invention also contemplates applying a dynamic voltage to the second electrode while maintaining the spaced first and third electrodes at a fixed voltage. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. In a three-beam inline electron gun system for a color cathode ray tube having a screen and a partially self-converging yoke which partially but incompletely converges the three beams and undesirably imparts astigmatism to the beams in off-center regions of the screen, apparatus comprising:

an electron beam source for developing three electron beams;

focusing means for focusing said three electron beams at the screen of the tube, said focusing means being constructed and arranged such that changes in focusing field strength alter beam convergence;

astigmatism correcting lens means for developing an astigmatic field component in the path of each of said beams when said lens means is appropriately excited; and means for modulating the strength of said astigmatic field component as a function of beam deflection angle to at least partially compensate for said yoke-induced astigmatism, said modulating of said astigmatic field component also modulating said focus field strength and thereby creating partial dynamic convergence effects;

said correcting lens means including electrode means having outer beam apertures shaped to create field-strength-dependent asymmetrical outer beam fields effective also to produce partial dynamic convergence, the dynamic convergence effects of said yoke, said focusing means and said correcting lens means combining additively.

2. For use in a color cathode ray tube system having a color tube with a phosphor screen, the system comprising:

a three-beam inline electron gun for exciting said screen, said gun including:

cathode means and focus lens means for developing a center beam and two outer beams and for forming three focused electron beam spots at the screen of the tube, said focus lens means being so constructed and arranged such that changes in focusing field strength alter beam convergence;

convergence means for converging said electron beams, said convergence means including electrode means having outer beam apertures shaped to create field-strength-dependent asymmetrical outer beam fields effective to at least partially converge said beams; and system signal generating means for developing a signal having amplitude variations correlated with the scan of the beams across the screen and for applying said signal to said focus lens means to cause the strength of said common focusing field to vary to produce dynamic focus and therewith a first dynamic convergence effect, and for applying said signal to said convergence lens means to produce a second dynamic convergence effect which adds to said first dynamic convergence effect.

3. For use in a color cathode ray tube system having a color tube with a phosphor screen, the system comprising:

a three-beam, inline electron gun for exciting said screen, said gun including:

cathode means and focus lens means for developing a center beam and two outer beams and forming three focused electron beam spots at the screen of the tube, and electrostatic quadrupole-developing means configured and arranged to develop a horizontally unbalanced quadrupole field in the path of each of said outer beams when appropriately excited; and system signal generating means for developing a signal having amplitude variations correlated with the scan of the beams across the screen and for applying said signal to said quadrupole developing means to produce a dynamic convergence effect on said beams.

4. The system defined by claim 3 wherein said quadrupole developing means comprises at least two facing electrodes, one adapted to receive a relatively higher excitation potential and the other a relatively lower excitation potential, the outer apertures of said electrode each having a profile which interacts with an aperture in a facing second electrode having an orthogonally different profile such as to create a quadrupolar field therebetween when different excitation potentials are applied to said first and second electrodes, at least a first one of said electrodes having a center aperture and two outer apertures arranged in a line along an electrode axis extending orthogonal to the gun axis, said outer apertures of said first electrode having profile distortions which are asymmetrical about said electrode axis and a vertical axis through the center aperture, but asymmetrical about respective vertical axes through the outer apertures to create asymmetrical outer beam fields.

5. For use in a color cathode ray tube system having a color tube with a phosphor screen, the system comprising:

a three-beam, inline gun for exciting said screen, said gun including:

cathode means and focus lens means for developing a center beam and two outer beams and for forming three focused electron beam spots at the screen of the tube, said focus lens means being constructed and arranged such that changes in focusing field strength alter beam convergence, and electrostatic quadrupole-developing means configured and arranged to develop a horizontally unbalanced quadrupole field in the path of each of said outer beams when appropriately excited; and system signal generating means for developing a signal having amplitude variations correlated with the scan of the beams across the screen and for applying said signal to said focus lens means to cause the strength of said common focusing field to vary to produce dynamic focus and therewith a first dynamic convergence effect, and for applying said signal to said electrostatic quadrupole-developing means to produce a second dynamic convergence effect which adds to said first dynamic convergence effect.

6. The system defined by claim 5 wherein said quadrupole-developing means comprises at least two facing electrodes, one adapted to receive a relatively higher excitation potential and the other a relatively lower excitation potential, the outer apertures of said electrode each having a profile which interacts with an aperture in a facing second electrode having an orthogonally different profile such as to create a quadrupolar field therebetween when different excitation potentials are applied to said first and second electrodes, at least a first one of said electrodes having a center aperture and two outer apertures arranged in a line along an electrode axis extending orthogonal to the gun axis, said outer apertures of said first electrode having profile distortions which are symmetrical about said electrode axis and a vertical axis through the center aperture, but asymmetrical about respective vertical axes through the outer apertures to create asymmetrical outer beam fields.

7. For use in a color cathode ray tube system having a three-beam color tube with a phosphor screen, the system comprising:

partially self-converging yoke means for deflecting said beams, said yoke means partially but incompletely self-converging the three beams, said yoke means introducing a quadrupole field which undesirably astigmatizes said beams;

a three-beam inline electron gun for exciting said screen, said gun including:

cathode means and focus lens means for developing a center beam and two outer beams and for forming three focus electron beam spots at the screen of the tube, said focus lens means forming a common main focusing field for all three of said beams which causes said outer beams to converge as a function of the strength of said main focusing lens field;

convergence means for converging said electron beams, comprising at least two facing electrodes, a first electrode being adapted to receive a relatively higher excitation potential and a second electrode a relatively lower excitation potential, at least one of said electrodes having a center aperture and two outer apertures arranged in a line along an electrode axis or orthogonal to the gun axis, said outer apertures having profile distortions which are symmetrical about said electrode axis and a vertical axis through the center aperture, but asymmetrical about respective vertical axes through the outer apertures; and system signal generating means for developing a signal having amplitude variations correlated with the scan of the beams across the screen and for applying said signal to said focus lens means to cause the strength of said common focusing field to vary to produce dynamic focus and therewith a first partial dynamic convergence effect, and to said convergence means to produce a second partial dynamic convergence effect, the dynamic convergence effects of said yoke means, said focus lens means, and said convergence means combining additively.

8. For use in a color cathode ray tube system having a three-beam color tube with a phosphor screen, the system comprising:

partially self-converging yoke means for deflecting said beams, said yoke means partially but incompletely self-converging the three beams; said yoke means introducing a quadrupole field which undesirably astigmatizes said beams;

a three-beam, inline electron gun for exciting said screen, said gun including:

cathode means and focus lens means for developing a center beam and two outer beams and forming three focused electron beam spots at the screen of the tube, and electrostatic quadrupole-developing means configured and arranged to develop a horizontally unbalanced quadrupole field in the path of each of said outer beams when appropriately excited; and system signal generating means for developing a signal having amplitude variations correlated with the scan of the beams across the screen and for applying said signal to said quadrupole developing means to produce a partial dynamic convergence effect on said beams, said dynamic convergence effect combining additively with the self-convergence produced by said yoke means.

9. The system defined by claim 8 wherein said quadrupole-developing means comprises at least two facing electrodes, one adapted to receive a relatively higher excitation potential and the other a relatively lower excitation potential, the outer apertures of said electrode each having a profile which interacts with an aperture in a facing second electrode having an orthogonally different profile such as to create a quadrupolar field therebetween when different excitation potentials are applied to said first and second electrodes, at least a first one of said electrodes having a center aperture and two outer apertures arranged in a line along an electrode axis extending orthogonal to the gun axis, said outer apertures of said first electrode having profile distortions which are symmetrical about said electrode axis and a vertical axis through the center aperture, but asymmetrical about respective vertical axes through the outer apertures to create asymmetrical outer beam fields.

10. For use in a color cathode ray tube system having a color tube with a phosphor screen, the system comprising:

partially self-converging yoke means for deflecting said beams, said yoke means partially but incompletely self-converging the three beams, said yoke means introducing a quadrupole field which undesirably astigmatizes said beams;

a three-beam, inline gun for exciting said screen, said gun including:

cathode means and focus lens means for developing a center beam and two outer beams and for forming three focused electron beam spots at the screen of the tube, said focus lens means forming a common main focusing field for all three of said beams which causes said outer beams to converge and deconverge as a function of the strength of said common main focusing lens field, and electrostatic quadrupole-developing means configured and arranged to develop a horizontally unbalanced quadrupole field in the path of each of said outer beams when appropriately excited; and system signal generating means for developing a signal having amplitude variations correlated with the scan of the beams across the screen and for applying said signal to said focus lens means to cause the strength of said common focusing field to vary to produce dynamic focus and therewith a first partial dynamic convergence effect, and for applying said signal to said electrostatic quadrupole-developing means to produce a second partial dynamic convergence effect, the dynamic convergence effects of said yoke means, said focus lens means, and said quadrupole-developing means combining additively.

11. The system defined by claim 10 wherein said quadrupole-developing means comprises at least two facing electrodes, one adapted to receive a relatively high excitation potential and the other a relatively lower excitation potential, the outer apertures of said electrode each having a profile which interacts with an aperture in a facing second electrode having an orthogonally different profile such as to create a quadrupolar field therebetween when different excitation potentials are applied to said first and second electrodes, at least a first one of said electrodes having a center aperture and two outer apertures arranged in a line along an electrode an axis extending orthogonal to the gun axis, said outer apertures of said first electrode having profile distortions which are symmetrical about said electrode axis and a vertical axis through the center aperture, but asymmetrical about respective vertical axes through the outer apertures to create asymmetrical outer beam fields.

12. For use in a color cathode ray tube system having a color tube with a phosphor screen, the system comprising:

self-convergent yoke means for deflecting said beams in a converging manner on the screen, said yoke means introducing a beam-astigmatizing quadrupole field;

a three-beam, inline electron gun for exciting said screen, said gun including:

means including cathode means for developing said beams;

three focus lens means for receiving said electron beams and forming three focused electron beam spots at the screen of the tube, said focus lens means each having a plurality of electrode means spaced along a lens axis parallel to a gun central axis, wherein at least two of said electron beams are off-axis with respect to said gun central axis;

convergence means effective to converge the off-axis beams when appropriately excited, said convergence means including beam bending means for producing an asymmetrical field in the path of said beam for diverting said beam from a straight line path, comprising at least two facing electrodes adapted to receive different excitation potentials and having coaxial beam-passing openings, at least one of said openings being symmetrical about a first electrode axis but asymmetrical about an orthogonal second electrode axis to thereby produce said asymmetrical field;

means for developing and applying to said electrode means of said focus lens means potentials which form one or more focusing field components between said electrode means; and system signal generating means for developing a signal having amplitude variations correlated with a scan of the beams across the screen and for applying said signal to at least one of said electrode means and to said convergence means, to simultaneously cause, as a function of beam deflection angle, (1) the strength of said one or more focusing field components to weaken to produce a dynamic focusing effect, and (2) the strength of said asymmetrical field component affecting said off-axis beams to weaken to produce a dynamic convergence effect;

whereby the application of said signal, in addition to adjusting the focus of the beams and compensating for the astigmatizing effect of said yoke, provides an additional measure of beam convergence to reduce the self-convergence demands on the yoke.

13. The system defined by claim 12 wherein said three focus lens means are of unitized inline construction and are characterized by forming a main focusing field common to all three of said beams.

14. An electron gun system for use in a color cathode ray tube having a screen and comprising:

means including cathode means for developing three electron beams;

three focus lens means for receiving said electron beams and forming three focused electron beam spots at the screen of the tube, said focus lens means each having first and second electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means, wherein said first electrode means is maintained at a lower potential than said second electrode means;

said off-axis focus lens means each being so structured and arranged as to cause a focusing field component to be asymmetrical and effective to statically converge the off-axis beams, wherein said off-axis focus lens means each includes an aperture in said first electrode through which a respective electron beam is directed having a notch therein extending outwardly away from said gun central axis; and signal generating means for developing a signal having amplitude variations correlated with a scan of the beams across the screen and for applying said signal to at least one of said electrode means to simultaneously cause, as a function of beam angle, the strength of said asymmetrical field component affecting said off-axis beams to weaken to produce a dynamic convergence effect.

15. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means;

said off-axis focus lens means each being so structured and arranged as to cause a focusing field component to be asymmetrical and effective to converge the off-axis beams, each of said off-axis focus lens means including beam bending means for producing asymmetrical fields in the paths of said outer beams for diverting said outer beams from respective straight line paths toward a common point of convergence, comprising at least two facing electrodes, a first electrode being adapted to receive a relatively higher excitation potential and a second electrode a relatively lower excitation potential, wherein one of said electrodes includes a center opening and two outer beam-passing openings arranged in line along an electrode horizontal axis orthogonal to the gun axis, said outer openings having opening distortions which are symmetrical about said electrode horizontal axis and a vertical axis through the center opening, but asymmetrical about respective vertical axes through the outer openings to thereby produce said asymmetrical fields for said outer beams; and signal generating means for developing a signal having amplitude variations correlated with a scan of the beams across the screen and for applying said signal to at least one of said electrode means to simultaneously cause, as a function of beam deflection angle, (1) the strength of said one or more focusing field components to weaken to produce a dynamic focusing effect, and (2) the strength of said asymmetrical field component affecting said off-axis beams to weaken to produce a dynamic convergence effect;

whereby said gun system provides control of convergence and focus with a single dynamic signal.

16. The system defined by claim 15 wherein said three focus lens means are of unitized inline construction and are characterized by forming a main focusing field common to all three of said beams.

17. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means;

said off-axis focus lens means each including an outer beam-passing opening so structured and arranged as to cause a focusing field component to be asymmetrical and effective to statically converge the off-axis beams, said outer openings having profile distortions which are symmetrical about said electrode axis and a vertical axis through the center opening, but asymmetrical about respective vertical axes through the outer openigns, said profile distortions each taking the form of an outwardly extending opening enlargement; and signal-generating means for developing a signal having amplitude variations correlated with a scan of the beams across the screen and for applying said signal to at least one of said electrode means, and to said convergence means to simultaneously cause, as a function of beam deflection angle, (1) the strength of said one or more focusing field components to weaken to produce a dynamic focusing effect, and (2) the strength of said asymmetrical field component affecting said off-axis beams to weaken to produce a dynamic convergence effect, whereby said gun system provides control of convergence and focus with a single dynamic signal.

18. The system defined by claim 17 wherein said three focus lens means are of unitized inline construction and are characterized by forming a main focusing field common to all three of said beams.

19. An electron gun system for use in a color cathode ray tube having a screen and comprising:

means including cathode means for developing three electron beams;

three focus lens means for receiving said electron beams and forming three focused electron beam spots at the screen of the tube, said focus lens means each having a plurality of electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means;

said off-axis focus lens means each being so structured and arranged as to cause a focusing field component to be asymmetrical and effective to converge the off-axis beams;

each of said focus lens means including first and second quadrupole-developing electrode means located in a substantially focus-field-free region therewithin and so configured and arranged as to develop a quadrupolar field in the path of each of said beams when a voltage difference is established therebetween, wherein said electrode means includes first, center and third electrodes and wherein said center electrode is adapted to receive a lower potential than said first and third electrodes, and wherein said center electrode has a center opening and two outer openings arranged in a line along an electrode axis orthogonal to the gun axis, said outer openings having profile distortions in the form of outwardly directed notches which are symmetrical about said electrode axis and a vertical axis through the center opening, but asymmetrical about respective vertical axes through the outer openings; and signal-generating means for developing a signal having amplitude variations correlated with a scan of the beams across the screen and for applying said signal to at least one of said electrode means, to said convergence means, and to said quadrupole-developing means to simultaneously cause, as a function of beam deflection angle, (1) the strength of said one or more focusing field components to weaken to produce a dynamic focusing effect, (2) the strength of said asymmetrical field component affecting said off-axis beams to weaken to produce a dynamic convergence effect, and (3) the strength of said quadrupolar field to increase to produce a dynamic astigmatism-correction effect.

20. The apparatus defined by claim 19 wherein the openings in said center electrode are keyhole-shaped and aligned with the vertical axis.

21. An aperture as defined by claim 20 wherein said first and third electrodes are adapted to receive a common excitation potential higher than that received by said center electrode, and wherein each of said first and third electrodes have a center opening and two outer openings arranged in a line along the electrode axis orthogonal to the gun axis, said outer openings having profile distortions which are symmetrical about said electrode axis and a vertical axis through the center opening, but asymmetrical about respective vertical axes through the outer openings.

22. The apparatus defined by claim 21 wherein said notches are disposed in a center portion of a keyhole-shaped aperture and extend outwardly away from said center aperture.

23. For use in a color cathode ray tube (CRT) wherein first, second and third inline electron beams are directed onto a phosphorescing screen in the CRT, with said second beam disposed intermediate said first and third beams, an electron gun comprising:

cathode means for generating electrons;

crossover means for receiving electrons from said cathode means and for forming a beam crossover;

first focusing means driven by a dynamic voltage for focusing the inline electron beams on the phosphorescing screen, wherein a misconvergence is present among the electron beams on the phosphorescing screen; and second focusing means disposed adjacent to said first focusing means for displacing the first and third electron beams horizontally away from the second beam for reducing said misconvergence and bringing said electron beams into convergence near the lateral portions of the phosphorescing screen, wherein said second focusing means is maintained at a lower voltage than said first focusing means when the electron beams are off-center on the screen and includes first and third outer apertures and a second middle aperture through which respective ones of the electron beams are directed, and wherein said first and third outer apertures each include an outwardly directed notch.

24. An electron gun system for use in a color cathode ray tube having a screen and comprising:

means including cathode means for developing three electron beams;

three focus lens means for receiving said electron beams and forming three focused electron beam spots at the screen of the tube, said focus lens means each having first and second electrode means spaced along a lens axis parallel to the other lens axes and parallel to a gun central axis, at least two of which lens axes are off-axis with respect to said gun central axis;

means for developing and applying to said electrode means of each of said focus lens means potentials which form one or more focusing field components between said electrode means, wherein said first electrode means is maintained at a lower potential than said second electrode means;

said off-axis focus lens means each being so structured and arranged as to cause a focusing field component to be asymmetrical and effective to converge the off-axis beams, each of said off-axis focus lens means including beam bending means for producing asymmetrical fields in the paths of said outer beams for diverting said outer beams from respective straight line paths toward a common point of convergence, comprising at least two facing electrodes, a first electrode being adapted to receive a relatively higher excitation potential and a second electrode a relatively lower excitation potential, wherein one of said electrodes includes a center opening and two outer beam-passing openings arranged in line along an electrode horizontal axis orthogonal to the gun axis, said outer openings having opening distortions which are symmetrical about said electrode horizontal axis and a vertical axis through the center opening, but asymmetrical about respective vertical axes through the outer openings to thereby produce said asymmetrical fields for said outer beams; and signal generating means for developing a signal having amplitude variations correlated with a scan of the beams across the screen and for applying said signal to at least one of said electrode means to simultaneously cause, as a function of beam angle, the strength of said asymmetrical field component affecting said off-axis beams to weaken to produce a dynamic convergence effect.

* * * * *